US008807720B2

(12) United States Patent
Fujisawa et al.

(10) Patent No.: US 8,807,720 B2
(45) Date of Patent: Aug. 19, 2014

(54) PRINTING MATERIAL CARTRIDGE, CARTRIDGE SET AND PRINTING APPARATUS

(75) Inventors: Kazuhito Fujisawa, Minowa-machi (JP); Shuichi Nakano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 143 days.

(21) Appl. No.: 13/224,207

(22) Filed: Sep. 1, 2011

(65) Prior Publication Data

US 2012/0081478 A1 Apr. 5, 2012

(30) Foreign Application Priority Data

Sep. 30, 2010 (JP) ..... 2010-197314
Jul. 8, 2011 (JP) ..... 2011-151692

(51) Int. Cl.
*B41J 29/393* (2006.01)
*B41J 2/14* (2006.01)
*B41J 2/175* (2006.01)

(52) U.S. Cl.
USPC ..... 347/86; 347/50; 347/19

(58) Field of Classification Search
USPC ..... 347/19, 50, 86
See application file for complete search history.

(56) References Cited

U.S. PATENT DOCUMENTS

| | | | |
|---|---|---|---|
| 4,709,246 | A | 11/1987 | Piatt et al. |
| 6,825,675 | B1 | 11/2004 | Robbins |
| 6,923,531 | B2 | 8/2005 | Saruta |
| 2002/0112878 | A1 | 8/2002 | Ishizawa et al. |
| 2004/0027400 | A1 | 2/2004 | Ryu et al. |
| 2004/0183848 | A1 | 9/2004 | Hasseler |
| 2005/0276617 | A1 | 12/2005 | Matsumoto et al. |
| 2007/0092270 | A1 | 4/2007 | Inukai |
| 2007/0149044 | A1 | 6/2007 | Asauchi |
| 2008/0299819 | A1 | 12/2008 | Kakutani |
| 2009/0051746 | A1 | 2/2009 | Asauchi |
| 2009/0058944 | A1 | 3/2009 | Asauchi |
| 2009/0237439 | A1 | 9/2009 | Ishizawa et al. |
| 2009/0262161 | A1 | 10/2009 | Nishihara |
| 2009/0289977 | A1 | 11/2009 | Asauchi |
| 2010/0007702 | A1 | 1/2010 | Kosugi |
| 2010/0289847 | A1 | 11/2010 | Ishizawa et al. |
| 2013/0027483 | A1 | 1/2013 | Asauchi |

FOREIGN PATENT DOCUMENTS

| | | | |
|---|---|---|---|
| EP | 1 445 109 | A1 | 8/2004 |
| JP | 03-284953 | A | 12/1991 |
| JP | 06-155758 | A | 6/1994 |
| JP | 06-262771 | A | 9/1994 |
| JP | 2002-198627 | A | 7/2002 |

(Continued)

OTHER PUBLICATIONS

Extended European Search Report of Corresponding EP Application No. 11179590.2, dated Feb. 8, 2013. 9 pages.

*Primary Examiner* — Jannelle M Lebron
(74) *Attorney, Agent, or Firm* — Kilpatrick Townsend & Stockton LLP

(57) ABSTRACT

A printing apparatus includes a holder in which a cartridge set that is configured of N printing material cartridges is mounted and a mounting detection circuit for detecting a mounting state of the printing material cartridge inside the holder. Each of N printing material cartridges has a storage device for storing information regarding the contained printing material, an electric device for the mounting detection, storage device terminals and the electric device terminals. The electric device for N printing material cartridges is configured such that the detection current is predetermined threshold value current or more when N printing material cartridges are all mounted inside the holder.

9 Claims, 18 Drawing Sheets

(56) References Cited

FOREIGN PATENT DOCUMENTS

| | | | |
|---|---|---|---|
| JP | 2002-273900 | A | 9/2002 |
| JP | 2003-300333 | A | 10/2003 |
| JP | 2005-119228 | A | 5/2005 |
| JP | 2005-326779 | A | 11/2005 |
| JP | 2006-030963 | A | 2/2006 |
| JP | 2007-121551 | A | 5/2007 |
| JP | 2007-168078 | A | 7/2007 |
| JP | 2007-196664 | A | 8/2007 |
| JP | 2008-298536 | A | 12/2008 |
| JP | 2009-241591 | A | 10/2009 |
| JP | 2009-274438 | A | 11/2009 |

$$I_{DET}=\frac{VHV}{R_c} \qquad R_c=R\frac{1}{\sum_{j=1}^{N}\frac{1}{2^j}}$$

REFERENCE EXAMPLE
(MOUNTING DETECTION CIRCUIT ACCORDING TO VOLTAGE VALUE)

REFERENCE EXAMPLE
(MOUNTING DETECTION ACCORDING TO VOLTAGE VALUE)

PRINTING MATERIAL CARTRIDGE, CARTRIDGE SET AND PRINTING APPARATUS

BACKGROUND

1. Technical Field

The present invention relates to a printing material cartridge, a cartridge set and a printing apparatus in which the printing material cartridge is mountable.

2. Related Art

In recent years, a printing material cartridge is used, in which a storage device containing information (for example, ink remainder amount) regarding the printing material is loaded. Also, a technique that performs a mounting detection of the printing material cartridge is used. For example, in JP-A-2005-119228, a CPU of a printing apparatus communicates with a storage device of an ink cartridge so as to detect whether the ink cartridge is mounted or not.

However, in JP-A-2005-119228, if the mounting detection is performed during a user performing an ink cartridge exchange operation, the mounting and dismounting of the ink cartridge requires that the storage device of the cartridge be in a conductive state. In this case, a hot-plugging of the storage device is performed so that stress is applied to a semiconductor element inside the storage device by the hot-plugging and there is a possibility of inducing a bit error. Meanwhile, if the CPU does not access the storage device of the cartridge during the ink cartridge exchange operation in order to prevent the bit error, a display panel of the printing apparatus does not display which cartridge is not mounted and the user cannot be informed during the exchange operation thereof, thus there is a problem that user convenience is greatly impaired.

Also, a mounting detection technique of the ink cartridge is disclosed in JP-A-3-284953. In JP-A-3-284953, a mounting detection circuit of a printing apparatus detects a voltage that varies according to an ink resistance value inside the ink cartridge and then determines if the ink cartridge is mounted or not. However, in this technique, there is a problem that a mounting detection wiring is required to be individually arranged between each cartridge and a mounting detection circuit of the printing apparatus in order to detect the presence or absence of an individual cartridge in a plurality of ink cartridges.

JP-A-6-262771 discloses a technique in which conductive sections or resistance bodies are provided in a ink cartridge, the conductive sections or the resistance bodies are connected in series or in parallel when four ink cartridges for four colors are mounted in a printer and mounting states of the ink cartridges are detected from a voltage that is obtained in the circuits that are connected in series or in parallel. More specifically, in a first embodiment of JP-A-6-262771, the voltage is input through one signal line into a MPU according to the mounting states of the ink cartridge set in which four ink cartridges are one unit. The MPU determines, according to the voltage value, any one of (i) a usual ink cartridge set is mounted, (ii) an ink cartridge is set that is different from the usual ink cartridge set mounted and (iii) an ink cartridge is unmounted (non-mounted) or mis-mounted, and then performs a process according to the respective case. In the first embodiment, the type of the cartridge set in which four ink cartridges are one unit is detected, however the detection cannot be performed if the resistance value in even one of four cartridges is different. Thus, in a second embodiment of JP-A-6-262771, inventors design that each resistance body is provided with respect to each ink cartridge the voltages are input into the MPU respectively by four signal lines that are provided individually corresponding the resistance bodies, and the mounting state or type of an individual ink cartridge can be detected according to the voltage. As described above, in JP-A-6-262771, a technique where the mounting states or types of the ink cartridge set (in other words, four ink cartridges is one unit) are determined using one signal line that is in common in four ink cartridges and a technique where the mounting states or types of individual ink cartridge using four signal lines corresponding to four ink cartridges respectively is disclosed. However, even in the techniques of JP-A-6-262771, there is a problem in that wiring for the mounting detection is required to be individually arranged between each cartridge and the mounting detection circuit of the printing apparatus in order to detect the presence or absence of the mounting of an individual cartridge. In addition, in JP-A-6-262771, there is a problem that since arrangement positions of the conductive bodies or the resistances are different in the individual cartridges, printer side terminals are also required to be in different positions and the configuration of the apparatus becomes complicated.

In the mounting detections of JP-A-3-284953 and JP-A-6-262771, the voltage is detected and the mounting state is determined according to the mounting state of the ink cartridge. However, errors are present due to manufacturing errors or temperature dependence in the practical resistance value so that for example, in a case where the voltages according to design are approximate values to each other, there is a problem that two types of the mounting states es are necessarily not easy to determine.

Also, above-described problems are not limited to ink cartridges and are the same as that of a printing material cartridge in which another type of printing material (for example, toner) are contained.

SUMMARY

An advantage of some aspects of the invention is that a technique is provided, in which a mounting detection of a printing material cartridge is capable of being performed by a device that is different from the related art.

The invention is to solve at least a portion of the above-described problems and is capable of being realized as the forms or applications described below.

Application 1

According to an aspect of the invention, there is provided a printing material cartridge detachably mountable inside a holder of a printing apparatus, the printing apparatus including a power supply and a mounting detection circuit having a mounting current value detection section that detects a detection current that flows when at least one printing material cartridge among a cartridge set configured of N (N is integer of 2 or more) printing material cartridges is mounted in the holder of a printing apparatus, the mounting detection circuit detecting a mounting state of the cartridge set in the holder according to the detection current,the printing material cartridge comprising:

a storage device storing information regarding the printing material cartridge;

an electric device for the mounting detection; and a plurality of terminals including the storage device terminals and the electric device terminals;

wherein, the electric device is, (i) connected in parallel to each other to the electric device of another printing material cartridge among the cartridge set between the power supply and the mounting current value detection section, and (ii) configured such that the detection current is a predetermined threshold value current or more when N printing material cartridges are mounted inside the holder a printing material cartridge mounted inside a holder of a printing apparatus including: a mounting detection circuit having a power supply for mounting detection; and a mounting current value detection section that detects a detection current that flows when a cartridge set configured of N (N is integer of 2 or more) printing material cartridges is mounted in the holder of a printing apparatus, the mounting detection circuit detecting a mounting state of the printing material cartridge in the holder according to the detection current, wherein the printing material cartridge has a storage device storing information regarding contained printing material, an electric device for the mounting detection and a plurality of terminals including the storage device terminals and the electric device terminals, the electric device is, (i) connected in parallel to each other to the electric device of another printing material cartridge configured of the cartridge set between the power supply for mounting detection and the mounting current value detection section, and (ii) configured such that the detection current that is detected at the mounting current value detection section is a predetermined threshold value current or more when N printing material cartridges are mounted inside the holder.

According to the printing material cartridge, the detection current is determined according to the mounting state of the electric device for the mounting detection that is provided individually from the storage device and the detection current is predetermined threshold value current or more when N printing material cartridges are mounted inside the holder so that the printing material cartridge is capable of determining whether it is properly mounted or not inside the holder. In addition, when the mounting detection of the printing material cartridge is performed, there is no need for concern of a bit error due to the hot-plugging of the storage device.

Application 2

It is preferable that the electric device is configured such that the detection current is a different current value according to $2^N$ types of mounting states regarding N printing material cartridges.

According to the configuration, the detection current takes the current value that is identified at once according to $2^N$ types of mounting states so that the mounting state of the printing material cartridge in the holder is capable of determining any one of $2^N$ types of mounting states by the detection current.

Application 3

It is preferable that the electric device is a resistance element.

According to the configuration, even if an error within allowable range is present at an individual resistance value, $2^N$ types of mounting states are capable of being identified by the detection current.

Application 4

According to another aspect of the invention, there is provided a cartridge set configured of N (N is integer of 2 or more) printing material cartridges and mountable inside a holder of the same printing apparatus, wherein individual printing material cartridge configured of the cartridge set is the printing material cartridges according to any one of claims 1 to 2 and arrangement of contacting sections of the printing apparatus side terminals and the plurality of terminals on each printing material cartridge is common in the N printing material cartridges.

According to the configuration, the arrangement of the contacting section in the printing apparatus side terminals or the terminals of the printing material cartridge is capable of being in common at N printing material cartridges so that the configuration of the terminals or the contacting section is simplified.

Application 5

It is preferable that the resistance element of an individual printing material cartridge have the same resistance value.

According to the configuration, the configuration of an individual printing material cartridge that is configured of cartridges is capable of being further simplified.

Application 6

It is preferable that a voltage applied to both ends of the resistance element of an individual printing material cartridge be 42V or less and a resistance value of the resistance element of an individual printing material cartridge may be 20 kΩ or more.

According to the configuration, even if the highest voltage is applied at the resistance element, the current is capable of being suppressed at 2.1 mA or less, so that excessive current does not flow in the circuit and the circuit is capable of being protected.

Application 7

According to still another aspect of the invention, there is provided a printing apparatus including: a holder in which a cartridge set configured of N (N is integer of 2 or more) printing material cartridges that are independently mountable and different from each other is mounted; a power supply for mounting detection; and a mounting detection circuit including a mounting current value detection section that detects a detection current that flows when one or more printing material cartridges in the holder are mounted, the mounting detection circuit detecting a mounting state of N printing material cartridges according to the detection current, wherein each of N printing material cartridges has a storage device storing information regarding the printing material cartridge, a electric device for the mounting detection and a plurality of terminals including the storage device terminals and the electric device terminals, the electric device of N printing material cartridges is, (i) connected in parallel between the power supply for mounting detection and the mounting current value detection section, and (ii) configured such that the detection current that is detected at the mounting current value detection section is a predetermined threshold value current or more when N printing material cartridges are mounted inside the holder.

According to the printing apparatus, the detection current is determined according to the mounting state of the electric device for the mounting detection that is provided individually from the storage device and the detection current is predetermined threshold value current or more when N printing material cartridges are all mounted inside the holder so that the printing material cartridge is capable of determining whether it is properly mounted or not inside the holder. In addition, when the mounting detection of the printing material cartridge is performed, there is no need for concern of a bit error due to the hot-plugging of the storage device.

Application 8

It is preferable that the electric device of N printing material cartridges be configured such that the detection current is a different current value according to $2^N$ types of mounting states regarding N printing material cartridges.

According to the configuration, the detection current takes the current value that is identified at once according to $2^N$ types of mounting states so that the mounting state of the printing material cartridge in the holder is capable of determining any one of $2^N$ types of mounting states by the detection current.

Application 9

It is preferable that the printing apparatus further comprising a resistance element of apparatus side;

wherein the electric device of $n^{th}$ (n=1 to N) printing material cartridge in N printing material cartridges is a resistance element, wherein the resistance element of $n^{th}$ printing material cartridge is connected the mounting detection resistances in series between the power supply for the mounting detection and the mounting current value detection section.

According to the configuration, even if an error within allowable range is present at an individual resistance value, $2^N$ types of mounting states are capable of being identified by the detection current.

Application 10

It is preferable that the mounting current value detection section include: a current-voltage converting section that generates the detection voltage by converting the detection current into the voltage; an A-D converting section that compares the mounting detection voltage with a plurality of threshold value voltages and converts it into a digital detection signal; and a voltage correction section that corrects the plurality of threshold value voltages according to variation of the voltage of the power source for the mounting detection, wherein the mounting detection circuit determines the mounting state of the printing material cartridge in the holder based on the digital detection signal.

According to the configuration, the threshold value voltage that is used when the detection current is converted into the digital detection signal is adjusted so as to follow the voltage of the power supply for the mounting detection so that the mounting state is capable of being exactly detected even though the voltage of the power supply for mounting detection is varied.

Application 11

It is preferable that a voltage that is higher than the voltage that is applied to the storage device terminal is supplied from the power supply for the mounting detection to the electric device terminal, wherein N printing material cartridges further have overvoltage detection terminals respectively, which are provided near the electric device terminals, and wherein the supply of the voltage from the power supply for the mounting detection to the electric device is stopped when the overvoltage is detected through the overvoltage detection terminal.

According to the configuration, when unintentional short-circuiting occurs between the terminal for the electric device terminal and overvoltage detection terminal by foreign materials such as ink or dust, the overvoltage is detected immediately so that the possibility that the high voltage for the mounting detection is applied to other circuits and then damage the other circuits caused by unintentional short-circuiting can be decreased.

Also, the invention can be realized in various embodiments for example, a printing material cartridge, a printing material cartridge set that is configured of a plurality types of printing material cartridges, a cartridge adapter, a cartridge adapter set that is configured of a plurality types of cartridge adapters, a printing apparatus and a mounting detection method of the printing material cartridge.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
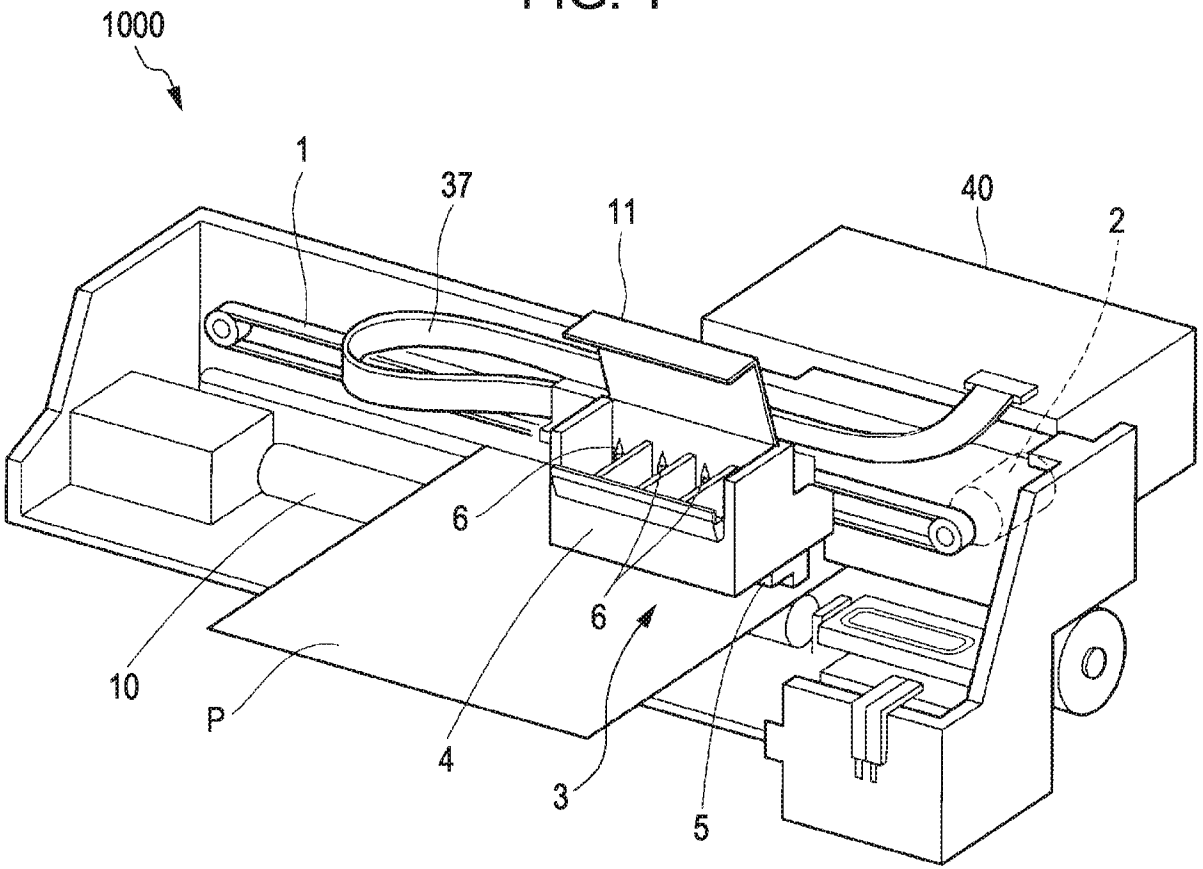
FIG. 1 is a perspective view illustrating a configuration of a printing apparatus of an embodiment according to the invention.

FIG. 1 is a perspective view illustrating a configuration of a printing apparatus according to a first embodiment of the invention. The printing apparatus 1000 has a sub-scanning feeding mechanism, a main scanning feeding mechanism and a head driving mechanism. The sub-scanning feeding mechanism transports a printing paper P in the sub-scanning direction using a paper feeding roller 10 of which the power is a paper feeding motor (not shown). The main scanning feeding mechanism reciprocates the carriage 3 that is connected to a driving belt in a main scanning direction using a power of a carriage motor 2. The head driving mechanism drives a printing head 5 included in the carriage 3 and performs ink discharge and dot formation. Furthermore, the printing apparatus 1000 includes a main control circuit 40 that controls each of above-described mechanism. The main control circuit 40 is connected to the carriage 3 through a flexible cable 37.

The carriage 3 includes a holder 4, the printing head 5 and a carriage circuit (described below). The holder 4 is detachably configured of a plurality of ink cartridges and arranged on the upper surface of the printing head 5. In the embodiment shown in FIG. 1, four ink cartridges are detachably mounted in the holder 4 independently and each of four types of ink cartridges, for example, black, yellow, magenta and cyan is mounted. In addition, a plurality types of arbitrary ink cartridges may be mounted in the holder 4. An openable cover 11 is attached to the holder 4. An ink supply needle 6 for supplying ink from the ink cartridge to the printing head 5 is arranged on the upper portion of the printing head 5.

Figure 2A:
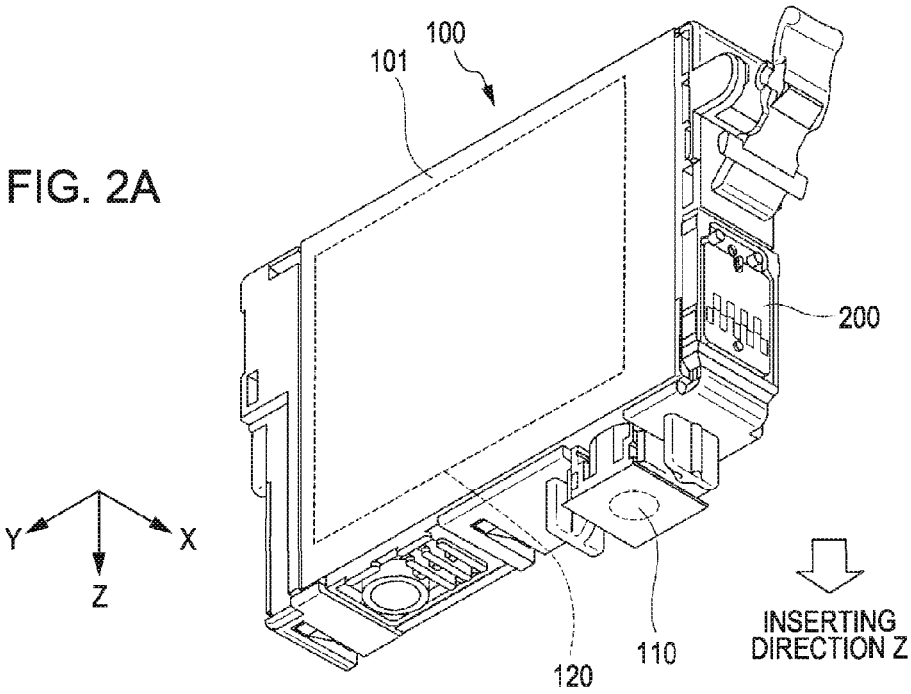
FIGS. 2A to 2B are perspective views illustrating a configuration of an ink cartridge according to the embodiment.
Figure 2B:
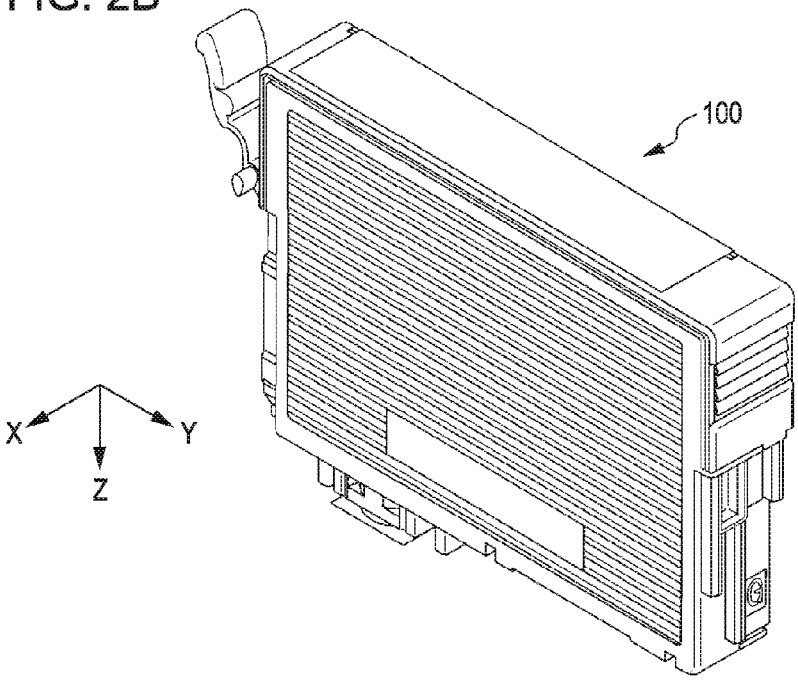

FIG. 2 is a perspective view illustrating a configuration of the ink cartridge according to the embodiment. An ink cartridge 100 includes a case 101 accommodating ink and a substrate 200 (also referred to as a circuit substrate). An ink chamber 120 accommodating ink is formed inside of the case 101. An ink supply opening 110 where an ink supply needle 6 of the printing apparatus is inserted when the ink cartridge 100 is mounted in the holder 4 is formed at the bottom surface of the case 101. In a state of before using, a film seals the opening of the ink supply opening 110. In addition, a sensor mechanism (not shown) that optically detects an ink remainder amount inside the ink cartridge 100 is provided at the ink cartridge 100 and the carriage 3. Hereinafter, the ink cartridge is also simply referred to as a "cartridge".

Figure 3A:
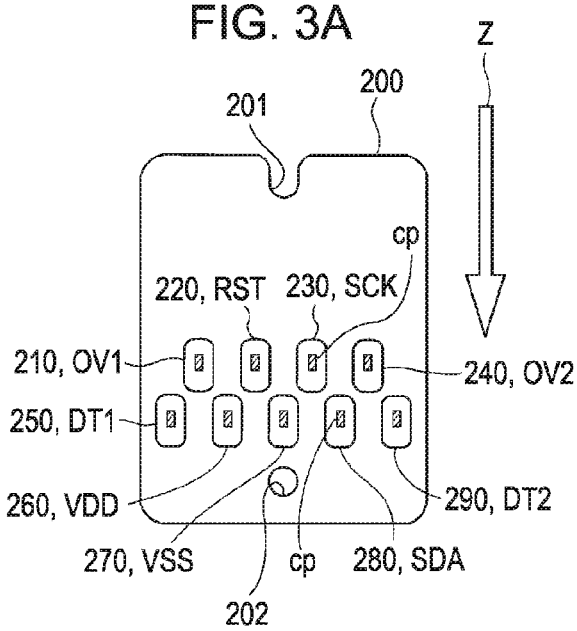
FIGS. 3A to 3C are drawings illustrating a configuration of a substrate and a contact point mechanism according to the embodiment.
Figure 3B:
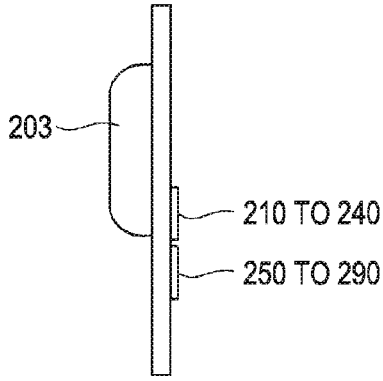

FIG. 3A shows a configuration of a surface of the substrate 200. The surface of the substrate 200 is a surface that is exposed to the outside when the substrate 200 is mounted in the ink cartridge 100. FIG. 3B is a drawing seen at the side view of the substrate 200. A boss slot 201 for fixing the substrate is formed at the upper end of the substrate 200 and a boss hole 202 is formed at the lower end of the substrate 200.

An arrow Z in FIG. 3A shows the insertion direction of the ink cartridge 100 into the holder 4. The substrate 200 includes a storage device 203 at the rear surface and also includes a group of terminals that are configured of nine terminals 210 to 290 at the front surface. The storage device 203 contains information regarding ink remainder amount of the ink cartridge 100. The terminals 210 to 290 are formed substantially rectangular-shape and arranged so as to form two rows, which are substantially vertical to the insertion direction Z. A row of two rows in the insertion direction Z side, in other words, a row that is positioned lower side in FIG. 3A is referred to as a lower side row and the other row opposite side to the insertion direction Z side, in other words, a row that is positioned upper side in FIG. 3A is referred to as a upper side row.

The terminals 210 to 240 that form the upper side row and the terminals 250 to 290 that form the lower side row are arranged as described below respectively.

Upper Side Row (1) a first overvoltage detection terminal 210

(2) a reset terminal 220

(3) a clock terminal 230

(4) a second overvoltage detection terminal 240

Lower Side Row (5) a first mounting detection terminal 250

(6) a power supply terminal 260

(7) a ground terminal 270

(8) a data terminal 280

(9) a second mounting detection terminal 290

Each of the terminals 210 to 290 includes a contacting section cp that contacts the corresponding terminal in a plurality of device side terminals. Each of the contacting sections cp of the terminals 210 to 240 that form the upper side row and each of the contacting sections cp of the terminals 250 to 290 that form the lower side row are arranged differently to each other and configures so called zigzag-shaped arrangement. Also, the terminals 210 to 240 that form the upper side row and the terminals 250 to 290 that form the lower side row are arranged differently to each other and configures so called zigzag-shaped arrangement so that terminal center each other is not in a line in the insertion direction Z.

The first mounting detection terminal 250 is adjacent to two terminals (the power supply terminal 260 and the first overvoltage detection terminal 210) and the first overvoltage detection terminal 210 of these terminals is near the first mounting detection terminal 250, and especially, is arranged nearest to the first mounting detection terminal 250. Similarly, the second mounting detection terminal 290 is adjacent to two terminals (the second overvoltage detection terminal 240 and the data terminal 280) and the second overvoltage detection terminal 240 of these terminals is near the second mounting detection terminal 290, and especially, is arranged nearest to the second mounting detection terminal 290.

Regarding the relation between the contacting sections cp, the contacting section cp of the first mounting detection terminal 250 is adjacent to each of the contacting sections cp of two terminals (the power supply terminal 260 and the first overvoltage detection terminal 210). Similarly, the contacting section cp of the second mounting detection terminal 290 is adjacent to each of the contacting sections cp of two terminals (the second overvoltage detection terminal 240 and the data terminal 280).

As is understandable from FIG. 3A, the first and the second mounting detection terminals 250 and 290 are arranged at both ends of the lower side row, in other words, at the outermost side of the lower side row respectively. In addition, the number of terminals at the lower side row is greater than that of the upper side row and the length of the lower side row that is substantially vertical direction to the insertion direction Z is longer than that of the upper side row. Accordingly, the first and the second mounting detection terminals 250 and 290 are arranged at the outermost side of the terminals 210 to 290 that include the upper side row and the lower side row in a substantially vertical direction to the insertion direction Z.

Also, the contacting sections cp of the first and the second mounting detection terminals 250 and 290 are positioned at both ends of the lower side row that are formed by the contacting section cp of each of terminals, in other words, at the outermost side of the lower side row respectively. Also, the contacting sections cp of the first and the second mounting detection terminals 250 and 290 are positioned at the outermost side of the contacting sections cp of the mounting detection terminals 210 to 290 that include the upper side row and the lower side row in a substantially vertical direction to the insertion direction Z.

The first and the second overvoltage detection terminals 210 and 240 are arranged at both ends of the upper side row, in other words, at the outermost side of the upper side row. As a result, similar to the above description, the contacting sections cp of the first and the second overvoltage detection terminals 210 and 240 are arranged at both ends of the upper side row that are formed by the contacting section cp of each of terminals, in other words, at the outermost side thereof.

Accordingly, the terminals 220, 230, 260, 270, and 280 for the storage device 203 are arranged so as to be pinched from both sides between a pair of the first overvoltage detection terminal 210 and the first mounting detection terminal 250 and a pair of the second overvoltage detection terminal 240 and the second mounting detection terminal 290.

Figure 3C:
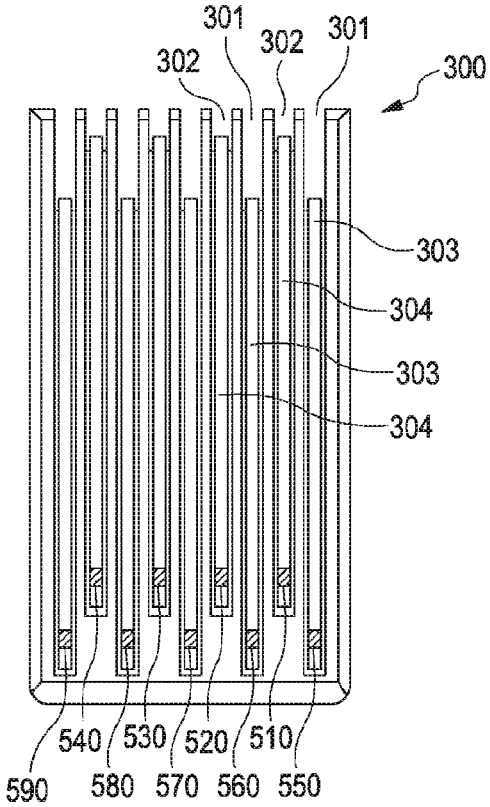

FIG. 3C is an explanatory drawing that explains an example of a contact point mechanism 300 that is provided inside of the holder 4. Two types of slits 301 and 302 having different depths with a substantially constant pitch are alternately formed in the contact point mechanism 300 so as to correspond to each of the terminals 210 to 290 in the substrate 200. In the example, total number of the slits 301 and 302 is nine. Contact point forming members 303 and 304 including the conductivity and the elasticity are inserted into each of the slits 301 and 302. An end of both ends of the contact point forming members 303 and 304, which are exposed to the inside of the holder 4, elastically contacts a corresponding terminal in the terminals 210 to 290 of the substrate 200. Portions 510 to 590 of the contact point forming members 303 and 304 that contact the terminals 210 to 290 are shown at the lower portion in FIG. 3C. In other words, the portions 510 to 590 that contact the terminals 210 to 290 function as the device side terminals so as to electrically contact a control circuit of the printing apparatus 1000 and the terminals 210 to 290 of the substrate 200. Hereinafter, these portions 510 to 590 are referred to as the "device side terminals 510 to 590". When the ink cartridge is mounted at the holder 4, the device side terminals 510 to 590 contact to the contacting sections cp of each of the terminals 210 to 290 (FIG. 3A) as described above respectively. In addition, the arrangement of the plurality of terminals 210 to 290 in the substrate 200 of the plurality of ink cartridges that are mounted inside the holder 4 is the same in all cartridges. Also, the arrangement of the device side terminals 510 to 590 for the plurality of ink cartridge is the same as in all cartridges. Accordingly, arrangement of the contacting sections cp of the plurality of the terminals 210 to 290 of the substrate 200 is also the same as the common arrangement of the plurality of ink cartridges. However, the arrangement of the terminals of the substrate 200 or the arrangement of the contacting sections thereof may be arranged differently per cartridge.

Figure 4:
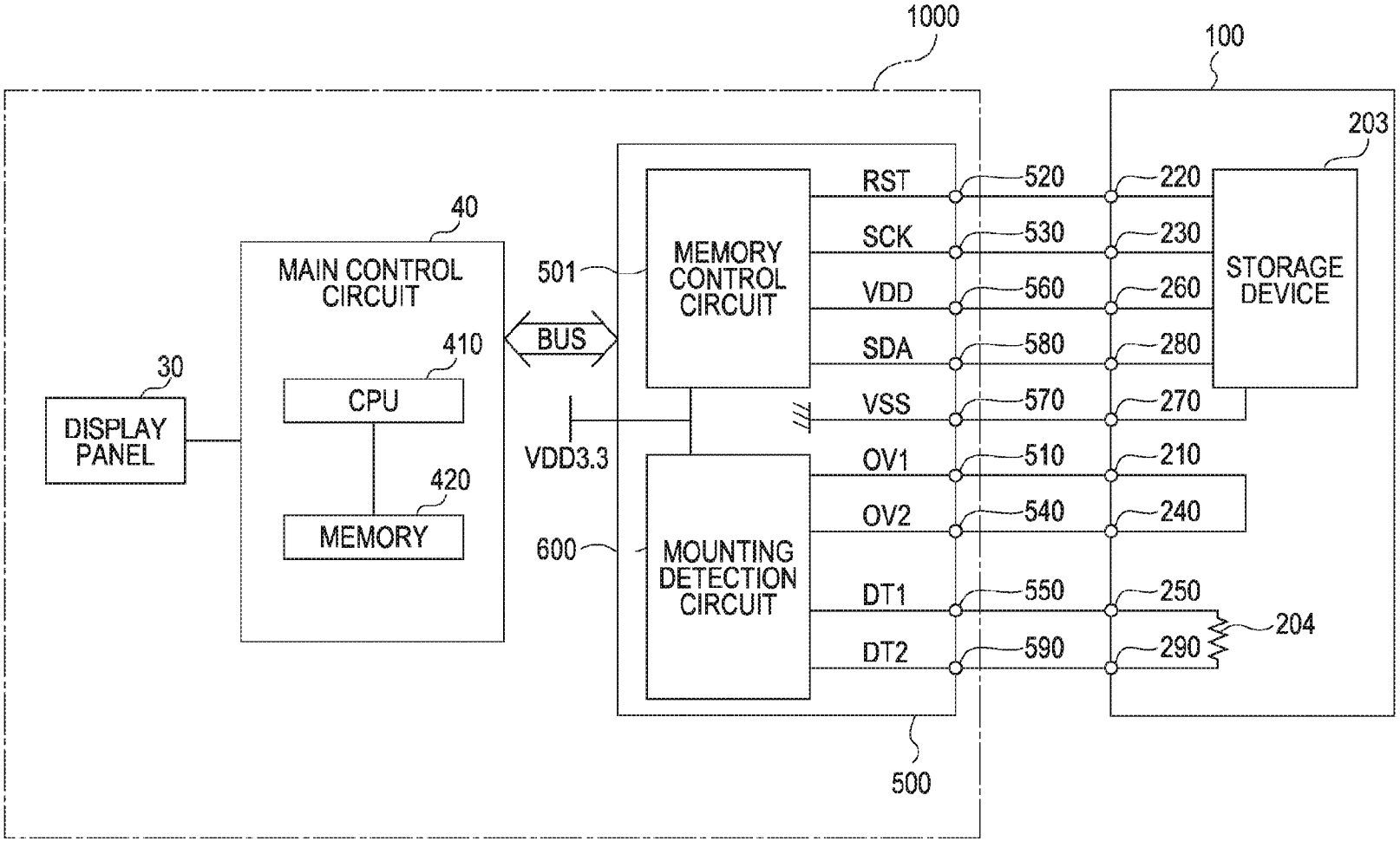
FIG. 4 is a block diagram illustrating an electrical configuration of the ink cartridge and the printing apparatus of a first embodiment.

FIG. 4 is a block diagram illustrating an electric configuration of the ink cartridge 100 and the printing apparatus 1000 of the first embodiment. The printing apparatus 1000 includes a display panel 30, the main control circuit 40 and a carriage circuit 500. The display panel 30 is a display section to inform a user of a variety of information such as the operation state of the printing apparatus 1000 and the mounting state of the cartridge. The main control circuit 40 has a CPU 410 and a memory 420. The carriage circuit 500 has a memory control circuit 501 and a mounting detection circuit 600.

The reset terminal 220, the clock terminal 230, the power supply terminal 260, the ground terminal 270 and the data terminal 280 of the nine terminals that are provided at the substrate 200 (FIG. 3A) of the ink cartridge 100 are electrically connected to the storage device 203. The storage device 203 includes for example, a memory cell array (not shown). The storage device 203 is a non-volatile memory determining a memory cell that does not receive an address from the memory control circuit 501, and reading and writing data based on a command data and a clock signal SCK that is transmitted from the memory control circuit 501. The clock terminal 230 is electrically connected to the terminal 530 of the carriage circuit 500 and is used in order to supply the clock signal SCK from the carriage circuit 500 to the storage device 203. A power supply voltage (for example, regular 3.3V) and the ground voltage (0V) are supplied to the power supply terminal 260 and the ground terminal 270 through the terminals 560 and 570 of printing apparatus 1000 side respectively. The data terminal 280 is electrically connected to a terminal 580 of the carriage circuit 500 and is used in order to communicate a data signal SDA between the carriage circuit 500 and the storage device 203. The reset terminal 220 is electrically connected to a terminal 520 of the carriage circuit 500 and is used in order to supply a reset signal RST from the carriage circuit 500 to the storage device 203.

The first and the second overvoltage detection terminals 210 and 240 are connected to each other through wiring inside the substrate 200 (FIG. 3A) of the cartridge 100 and are electrically connected to the terminals 510 and 540 of the carriage circuit 500 respectively. In addition, a state where two terminals are connected through wiring is referred to as "a short circuit connection" or "a conducting wire connection". The short circuit connection by the wiring is a different state from the unintentional short-circuiting. The overvoltage detection terminals 210, 240, 510, and 540 may be omitted. A resistance element 204 for mounting detection is provided between the first and the second mounting detection terminals 250 and 290, and are electrically connected to the terminals 550 and 590 of the carriage circuit 500 respectively.

Wiring names RST, SCK, VDD, SDA, VSS, OV1, OV2, DT1 and DT2 are applied to wirings that connect the carriage circuit 500 and the ink cartridge 100 by the device side terminals 510 to 590 and the terminals 210 to 290 of the substrate 200. From among these wiring names, the wiring names for the storage device use the same names as the signal names.

The memory control circuit 501 is a circuit to control the storage device 203 of the cartridge 100 so as to perform reading and writing of the data. The memory control circuit 501 and the storage device 203 of the cartridge are low voltage circuits that are operated at a relatively low voltage (in the embodiment, regular 3.3V).

The mounting detection circuit 600 is a circuit in order to perform the mounting detection of the cartridge in the holder 4. The mounting detection circuit 600 and the resistance element 204 of the cartridge are high voltage circuits that are operated at a high voltage (in the embodiment, regular 42V) compared to the storage device 203.

Figure 5A:
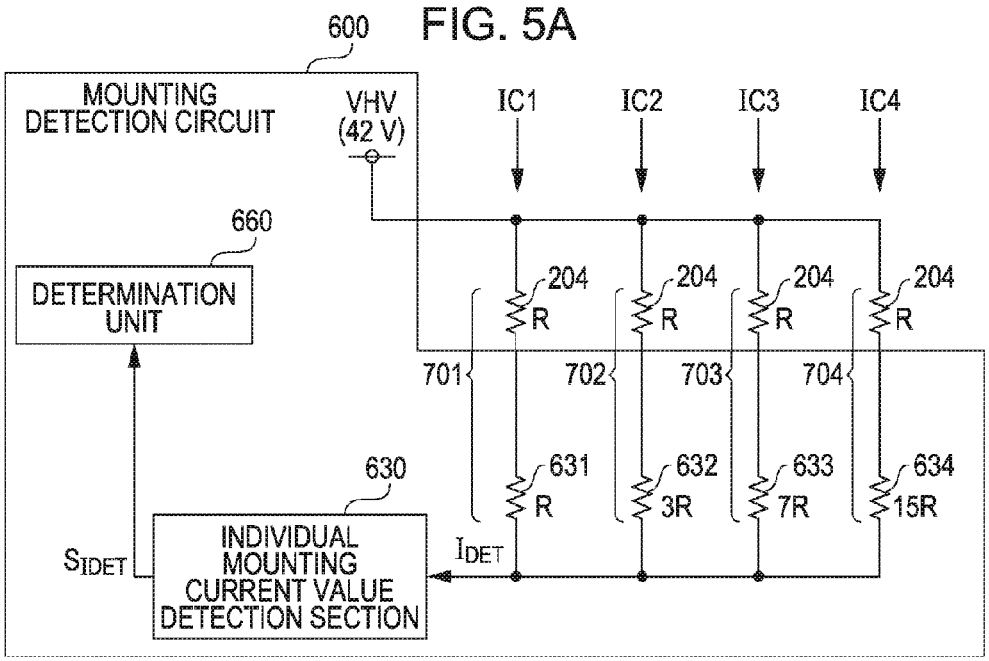
FIG. 5A is explanatory view illustrating a mounting detection circuit of the cartridge of the first embodiment.
Figure 5B:
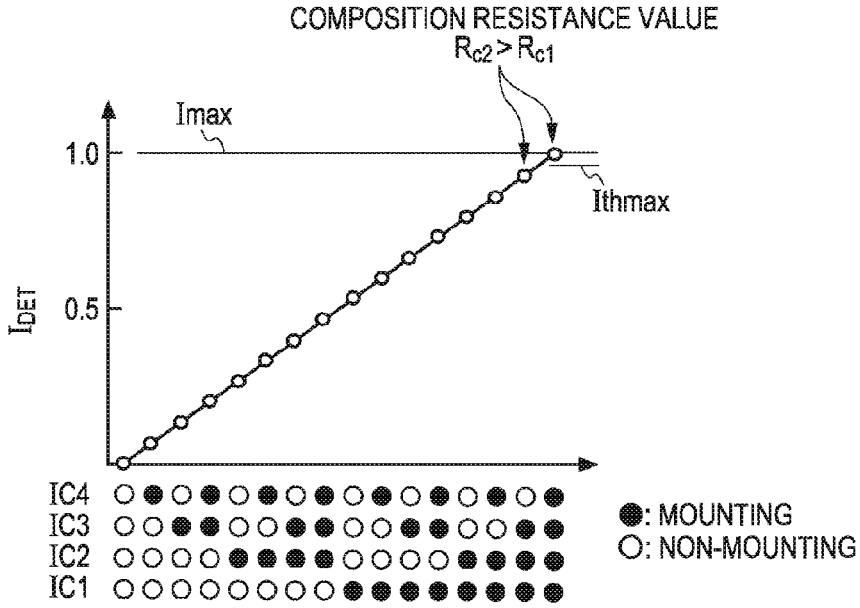
FIG. 5B is a graph illustrating a relation between a detection current and a mounting state of the first embodiment.

FIGS. 5A and 5B are explanatory drawings illustrating the content of a mounting detection process of the cartridge, which is performed by the mounting detection circuit. The mounting detection circuit 600 has a high voltage power supply VHV for mounting detection, an individual mounting current value detection section 630, the resistance elements 631 to 634 and a determination section 660. In addition, the individual mounting current value detection section 630 may be simply referred to as the "mounting current value detection section".

FIG. 5A shows a state where cartridges IC1 to IC4 that are mountable in the holder 4 of the printing apparatus are all mounted. The resistance values of the resistance elements 204 of four cartridges IC1 to IC4 is set to the same value R. Resistance elements 631 to 634 that are connected in series to the resistance element 204 of each of cartridges are provided inside the mounting detection circuit 600 respectively. Resistance values of the resistance elements 631 to 634 are set in different values from each other. Especially, the resistance value of the resistance element 63*n* that corresponds to the cartridge ICn of $n^{th}$ (n=1 to 4) of the resistance elements 631 to 634 is set to $(2^n-1)R$ (R is a constant value). As a result, the resistance having $2^nR$ of resistance value is formed according to the serial connection between the resistance element 204 inside $n^{th}$ cartridge and the resistance element 63*n* inside the mounting detection circuit 600. $2^n$R of the resistance with respect to the $n^{th}$ (n=1 to N) cartridge is connected in parallel with respect to the individual mounting current value detection section 630. In addition, hereinafter, the serial connection resistances 701 to 704 may be referred to as "resistance for mounting detection" or simply "resistance". A detection current $I_{DET}$ that is detected at the individual mounting current value detection section 630 is VHV/Rc that subtracts the voltage VHV from four composition resistance value Rc of four resistances 701 to 704. Here, when the number of cartridges is N, if N cartridges are all mounted, the detection current $I_{DET}$ is given in a formula below.

$$I_{DET} = \frac{VHV}{R_c} \tag{1}$$

$$R_c = R\frac{1}{\sum_{j=1}^{N}\frac{1}{2^j}} \tag{2}$$

When one or more cartridges are unmounted or non-mounted, according to that, the composition resistance value Rc is increased and the detection current $I_{DET}$ is decreased.

FIG. 5B shows a relation between a mounting state of the cartridges IC1 to IC4 and the detection current $I_{DET}$. The horizontal axis in the drawing shows sixteen types of mounting states and the vertical axis shows a value of the detection current $I_{DET}$ at the mounting states. Sixteen types of mounting states correspond to sixteen combinations that are obtained by arbitrarily selecting one to four from the four cartridges IC1 to IC4. In addition, each of the combinations is also referred to as a "subset". The detection current $I_{DET}$ is the current value that can identify at once the sixteen types of mounting states. In other words, each resistance value of four resistances 701 to 704 that correspond to four cartridges IC1 to IC4 is set such that the sixteen types of mounting states that are acquired from the four cartridges give composition resistance value Rc that are different from each other.

If four cartridges IC1 to IC4 are all mounting states, the detection current $I_{DET}$ is the maximum value I max. Meanwhile, in a state where only the cartridge IC4 that correspond to the resistance 704 having the largest resistance value is unmounted, the detection current $I_{DET}$ is 0.93 times the maximum value Imax. Accordingly, if investigation is performed whether the detection current $I_{DET}$ is the threshold value current Ithmax or more, or not which is predetermined value between two current values, it can detect whether four cartridges IC1 to IC4 are all mounted or not. In addition, in order to perform individual mounting detection, the reason for using a voltage VHV that is higher than the power supply voltage (about 3.3V) of the usual logic circuit is to increase the detection precision by widening the dynamic range of the detection current $I_{DET}$ so that the detection precision is increased.

Figure 5C:
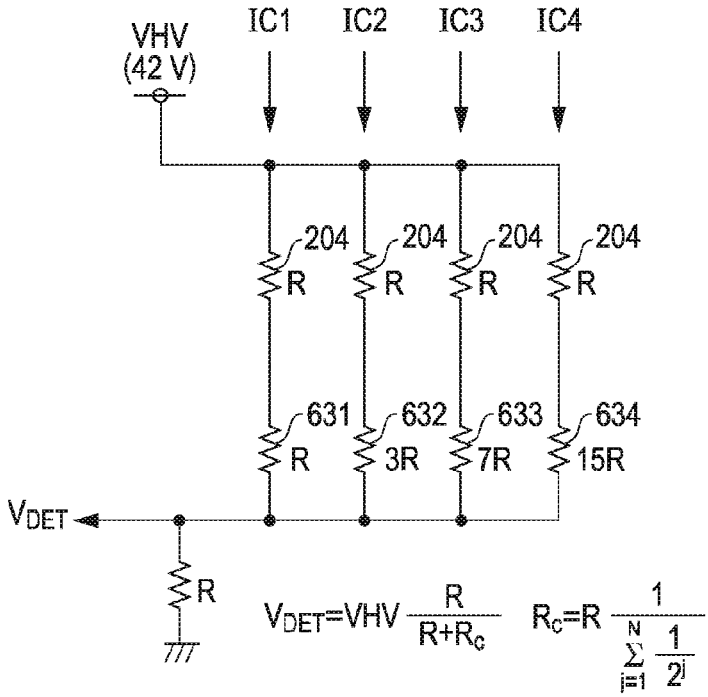
FIG. 5C is an explanatory view illustrating a mounting detection circuit of a cartridge of a reference example.
Figure 5D:
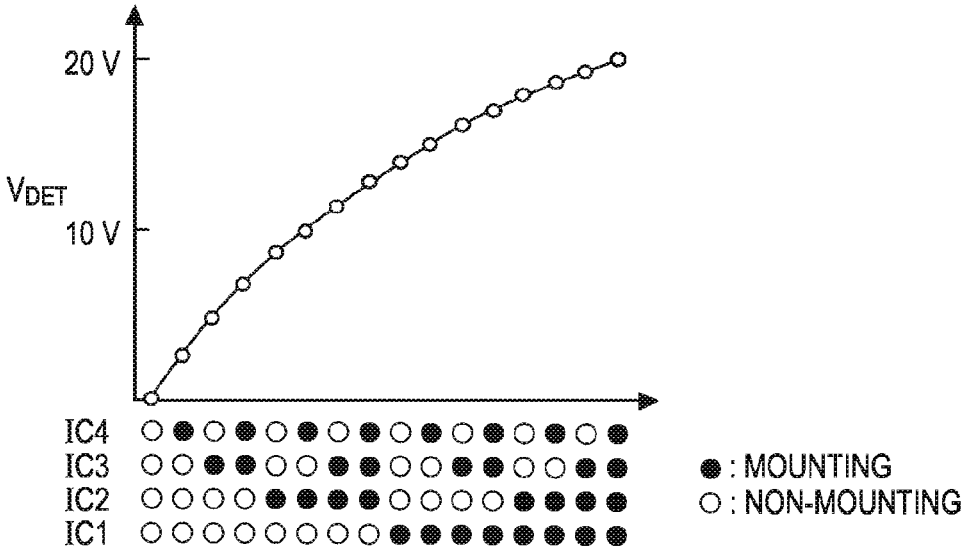
FIG. 5D is a graph illustrating a relation between a detection voltage and a mounting state of a reference example.

FIG. 5C shows a configuration of a mounting detection circuit of a reference example. The mounting detection circuit detects the mounting state of the cartridge by detecting the voltage $V_{DET}$ instead of current. The detection voltage $V_{DET}$ is a value that divides the power supply voltage VHV to the composition resistance Rc and other resistance R. Also, the value of the latter resistance R may be set to the resistance value of the resistance element 204 of the cartridge. In addition, it may be set to another arbitrary resistance value. FIG. 5D shows a relation between the mounting states of the cartridges IC1 to IC4 and the detection voltage $V_{DET}$ in the reference example. The detection voltages $V_{DET}$ take different values respectively according to sixteen types of mounting states of cartridge. Regarding this point, it is similar to the mounting detection circuit shown in FIG. 5A. Also, in the horizontal axis in FIGS. 5B and 5D, sixteen types of mounting states are sequentially arranged so that the composition resistance value Rc is further decreased by as much as the mounting state in the right side.

The graph of the detection current $I_{DET}$ shown in FIG. 5B shows a substantially straight relation with respect to sixteen types of the mounting states and increases in straight line according to going to the right end in FIG. 5B (according to decreasing of the composition resistance value Rc). Meanwhile, in the graph of the detection voltage $V_{DET}$ shown in FIG. 5D, the voltage value increases according to convex shape curve to upper side and the difference in the detection voltages $V_{DET}$ in the adjacent two mounting states decreases according to going to the right end in FIG. 5D (according to decreasing of the composition resistance value Rc). As the reference example, if the mounting state is detected using the detection voltage $V_{DET}$ according to the composition resistance value Rc, the difference in the voltages decreases in two mounting states of the right end in FIG. 5D so that two mounting states may not be surely exactly determined. Also, it is required that resistance having more precision (manufacturing error is small) be used in order to exactly determine these two mounting states so that it is a cause of increasing of the cost thereof. Meanwhile, in the first embodiment shown in FIGS. 5A and 5B, the voltage between the high voltage power supply VHV and the individual mounting current value detection section 630 is constant and the mounting state is detected by using the detection current $I_{DET}$ according to the composition resistance value Rc so that the difference in the detection currents $I_{DET}$ in two arbitrary adjacent mounting states is substantially constant through overall in FIG. 5B. Accordingly, in the first embodiment, the determination of the mounting state is easier than that of the reference example and the resistance having lower precision may be used. From this comparison, it is understandable that the configuration that detects the mounting state using the detection current $I_{DET}$ according to the composition resistance value Rc is preferable to the configuration that detects the mounting state using the detection voltage $V_{DET}$ according to the composition resistance value Rc.

The individual mounting current value detection section 630 converts the detection current $I_{DET}$ to a digital detection signal $S_{IDET}$ and then transmits the digital detection signal $S_{IDET}$ to the determination section 660. The determination section 660 can determine any one of the sixteen types of mounting states by the value of the digital detection signal $S_{IDET}$. When the determination is that one or more cartridges are unmounted, the determination section 660 displays the information (letter or image) illustrating the unmounting state at the display panel 30 and informs the information to the user.

In the first embodiment, the unmounting state of each of cartridges is displayed on the display panel 30 during the exchange of cartridges so that the user sees the display and then may perform the exchange of the cartridges. Especially, when cartridges are exchanged, the display panel 30 displays that the cartridge is changed from the unmounting to the mounting so that even though a user is inexperienced with cartridge exchange operation, the user is capable of processing next operation with an easy mind. In addition, in the first embodiment, mounting and removing, and mounting detection of the cartridge is capable of being performed in a state where the storage device 203 of the cartridge is in a non-conductive. Accordingly, a bit error that is generated by the so-called hot-plugging of the storage device is preventable.

B. Allowable Error of Resistance Element for Mounting Detection of Cartridge

As described in FIGS. 5A and 5B, the mounting detection process of the cartridge uses that the composition resistance value Rc is determined at once according to $2^N$ types of the mounting state regarding N cartridges so that the detection current $I_{DET}$ is determined at once according to that. Hereinafter, the allowable error of the resistance values of the resistances 701 to 704 is considered.

First of all, a case where the number N of cartridges is four is considered. When the allowable error of the resistance value is ϵ, the resistance value of each resistance element 204 (FIG. 5A) allows taking a value in a range of (1±ϵ)R. Also, the resistance values of four serial connecting resistances 701 to 704 that correspond to four cartridges IC1 to IC4 allow taking values in a range of (1±ϵ)2R, (1±ϵ)4R, (1±ϵ)8R and (1±ϵ)16R respectively. Meanwhile, two states of sixteen types of mounting states in FIG. 5B, where the difference in the composition resistances value Rc is smallest and then the detection current $I_{DET}$ is largest are the state that all cartridges IC1 to IC4 are mounted and the state that only fourth cartridge IC4 is non-mounted. Here, when the first composition resistance value in the state where all cartridges IC1 to IC4 are mounted is $R_{c1}$ and second composition resistance value in the state where only fourth cartridge IC4 is non-mounted is $R_{c2}$, $R_{c1}<R_{c2}$ is established. It is desirable that the relation be established even in a case where the resistance value of each of the resistances 701 to 704 varies in the range of the allowable error ϵ. At this time, the worst case scenario is a case where the first composition resistance value $R_{c1}$ takes the maximum value $R_{c1max}$ and the second composition resistance value $R_{c2}$ takes the minimum value $R_{c2min}$. At this time, it is desirable that $R_{c1max}<R_{c2min}$ be established and it may be rewritten as formula below.

$$\frac{1}{R_{c2min}} < \frac{1}{R_{c1max}} \tag{3}$$

Here, Rc1max is the composition resistance value in a case where all cartridges are mounted, and Rc2min is the composition resistance value in a case where only $4^{th}$ cartridge is not mounted.

$R_{c1max}$ and $R_{c2min}$ in the formula 3 are given in below formula respectively.

$$\frac{1}{R_{c1max}} = \frac{1}{(1+\varepsilon)R}\left\{\frac{1}{2}+\frac{1}{4}+\frac{1}{8}+\frac{1}{16}\right\} \tag{4}$$

$$\frac{1}{R_{c2min}} = \frac{1}{(1-\varepsilon)R}\left\{\frac{1}{2}+\frac{1}{4}+\frac{1}{8}\right\} \tag{5}$$

When the formulas (4) and (5) substitute to formula (3), formula (6) is established and if it is modified, it will be formula (7).

$$\frac{1}{(1-\varepsilon)R}\left\{\frac{1}{2}+\frac{1}{4}+\frac{1}{8}\right\} < \frac{1}{(1+\varepsilon)R}\left\{\frac{1}{2}+\frac{1}{4}+\frac{1}{8}+\frac{1}{16}\right\} \tag{6}$$

$$\frac{2\varepsilon}{1-\varepsilon} < \frac{1}{16}\times\frac{8}{7} \tag{7}$$

In the formula 7, the error ϵ is sufficiently small compared to 1, so that if (1−ϵ)=1, following formula is established, and the allowable error ϵ of the resistance value is 3.6%.

$$\epsilon<0.036=3.6\% \tag{8}$$

When the above-described consideration is generalized, if the number of cartridges is N, the allowable error ϵ is given according to following formula.

$$\varepsilon < \frac{1}{4(2^{N+1}-1)} \tag{9}$$

In other words, if the allowable error ϵ satisfies the formula (9), the composition resistance value Rc is always determined at once according to the mounting states of N cartridges and then the detection current $I_{DET}$ is capable of assuring the determination at once. However, it is desirable that the allowable error of the resistance value in practical design be set to a value that is smaller than the right side of the formula (9). In addition, the allowable error of the resistance values of the resistances 701 to 704 may be set to a sufficiently small value (for example, predetermined value that is 1% or less) without performing the above-described consideration.

C. Second Embodiment

Figure 6:
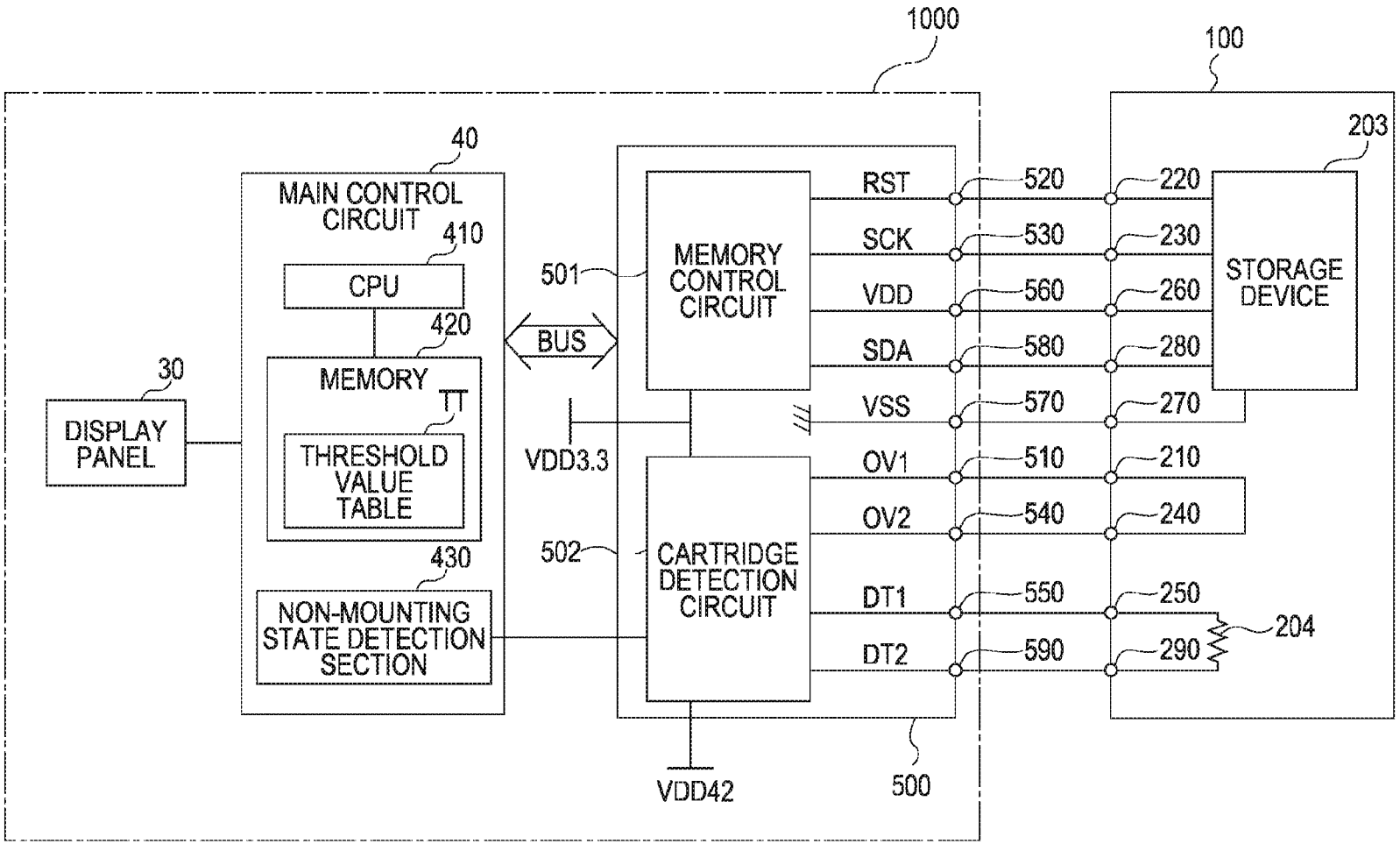
FIG. 6 is a block diagram illustrating an electrical configuration of the ink cartridge and the printing apparatus of second embodiment.

FIG. 6 is a block diagram illustrating an electric configuration of the ink cartridge 100 and the printing apparatus 1000 of a second embodiment. The main control circuit 40 has the CPU 410, the memory 420 and a non-mounting state detection section 430. A threshold value table TT is stored in the memory 420, which contains the threshold value that is used when the mounting of cartridge is determined whether present or not. The CPU 410 uses the threshold value that is read from the threshold value table TT so as to determine (described below) the type of cartridge that is mounted on the holder 4. In addition, it is desirable that the threshold value table TT be contained within the nonvolatile memory such as EEPROM. The carriage circuit 500 has the memory control circuit 501 and the cartridge detection circuit 502.

The cartridge detection circuit 502 is a circuit that cooperates with the main control circuit 40 and performs the mounting detection of the cartridge on the holder 4. In addition, in the second embodiment, the cartridge detection circuit 502 cooperates with the main control circuit 40 so that the mounting detection process is performed similar to the mounting detection circuit 600 (FIG. 6A) of the first embodiment. Accordingly, the circuits 502 and 40 are also referred to as the "mounting detection circuit". The cartridge detection circuit 502 and the cartridge resistance element 204 are high voltage circuits that are operated at the high voltage (in the embodiment, regular 42V) compared to the storage device 203.

Figure 7:
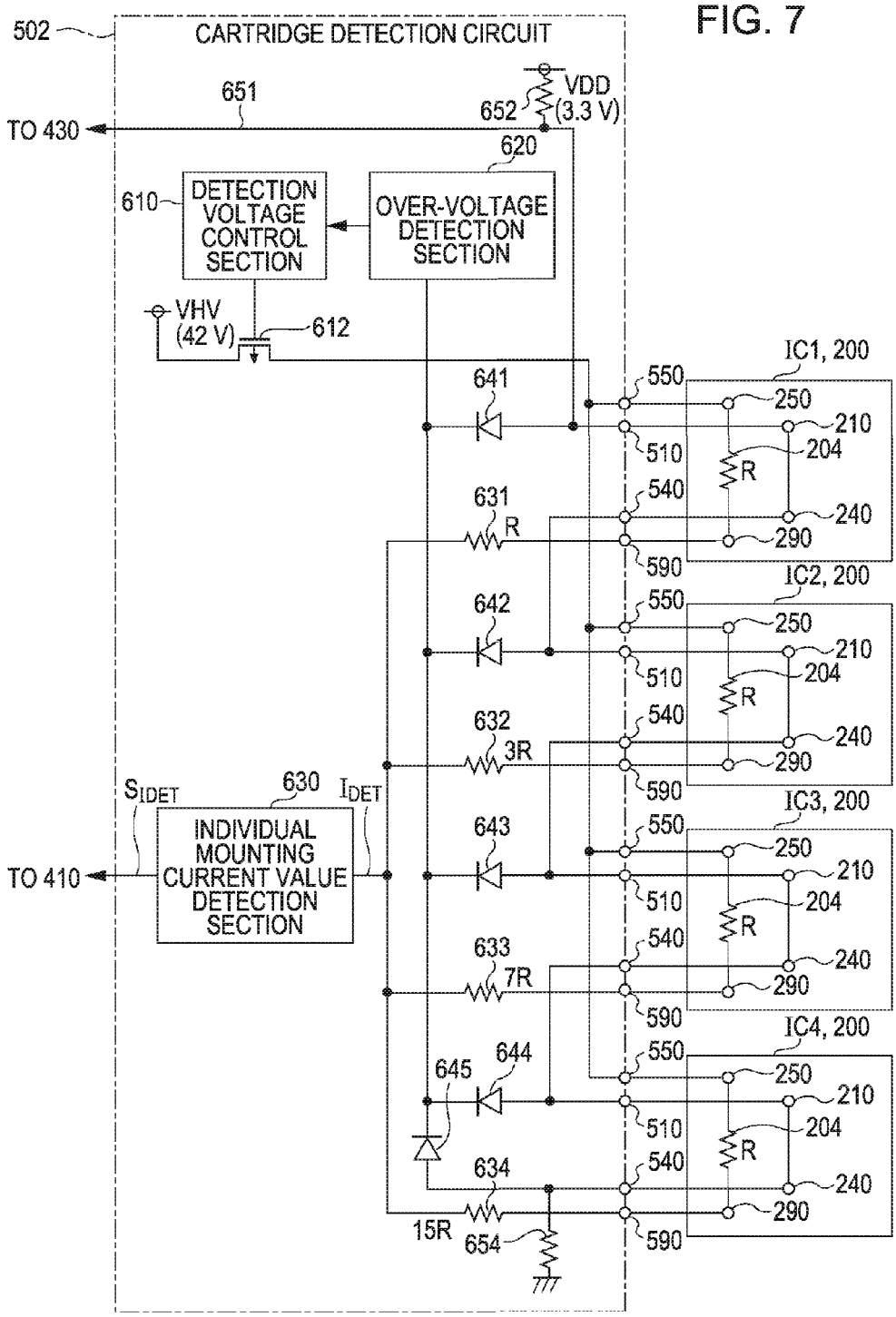
FIG. 7 is a drawing illustrating a configuration inside a cartridge detection circuit of the second embodiment.

FIG. 7 is a drawing illustrating a configuration of the inside of the cartridge detection circuit 502 of the second embodiment. Here, the state where four cartridges 100 are mounted on the holder is illustrated and reference numerals IC1 to IC4 are used to distinguish each of cartridges. The cartridge detection circuit 502 has a detection voltage control section 610, an overvoltage detection section 620 and the individual mounting current value detection section 630. The overvoltage detection section 620 is also referred to as a "short circuit detection section".

Inside of the cartridge detection circuit 502, the high voltage power supply VHV for mounting detection is provided. The high voltage power supply VHV is connected in parallel to four device side terminals 550 that are provided at the mounting position of each of the cartridges IC1 to IC4 through a transistor 612. The voltage value of the high voltage power supply VHV is referred to as "the high voltage VHV". on/off of the transistor 612 is controlled by the detection voltage control section 610. Each of the device side terminals 550 is connected to the first mounting detection terminal 250 of the corresponding cartridge. The resistance elements 204 are provided between the first and the second mounting detection terminal 250 and 290 inside each cartridge. The resistance values of the resistance elements 204 of four cartridges IC1 to IC4 is set to the same value R. Resistance elements 631 to 634 that are connected respectively in series to the resistance element 204 of each of cartridges inside the cartridge detection circuit 502 are provided. Resistance values of the resistance elements 631 to 634 are set in different values from each other. Especially, the resistance value of the resistance element 63*n* that corresponds to the $n^{th}$ (n=1 to 4) cartridge ICn of the resistance elements 631 to 634 is set to $(2^n-1)R$ (R is a constant value). As a result, the resistance connected in series having $2^nR$ of resistance value is formed according to the serial connection between the resistance element 204 inside $n^{th}$ cartridge and the resistance element 63*n* inside the cartridge detection circuit 502. In addition, these resistances connected in series are the same as that shown in FIG. 5A. $2^nR$ of the resistances 701 to 704 with respect to the $n^{th}$ (n=1 to N) cartridge is connected in parallel between the power supply VHV and the individual mounting current value detection section 630. The individual mounting current value detection section 630 detects the detection current $I_{DET}$ that is determined according to the mounting state of these cartridges. The detection current $I_{DET}$ is also referred to as a "mounting detection current". The detection current $I_{DET}$ is given in formula (1) and formula (2) described in the first embodiment.

The first and the second overvoltage detection terminals 210 and 240 are connected with a wiring inside each cartridge. The first overvoltage detection terminal 210 of the first cartridge IC1 is connected to a wiring 651 inside the cartridge detection circuit 502 through corresponding device side terminal 510 and the wiring 651 is connected to a low voltage power supply VDD through the resistance 652. In addition, the wiring 651 is connected to the non-mounting state detection section 430 (FIG. 6) inside the main control circuit 40. The voltage value of the low voltage power supply VDD is also referred to as the "low voltage VDD". The second overvoltage detection terminal 240 of $n^{th}$ (n=1 to 3) cartridge and the first overvoltage detection terminal 210 of $n+1^{st}$ cartridge are connected to each other through corresponding device side terminals 540 and 510. Also, the second overvoltage detection terminal 240 of $4^{th}$ cartridge IC4 is connected to the ground potential through a resistance 654. If all cartridges IC1 to IC4 are mounted inside the holder, the voltage of the wiring 651 that is connected to the non-mounting state detection section 430 divides the power supply voltage VDD to two resistances 652 and 654, and then is a predetermined voltage value. Meanwhile, if even one cartridge is unmounted, the voltage of the wiring 651 becomes the power supply voltage VDD. Accordingly, the non-mounting state detection section 430 is capable of determining whether the unmounting cartridge is present or not according to monitoring the voltage of the wiring 651. Thus, in the second embodiment, when all cartridges IC1 to IC4 are mounted inside the holder, the overvoltage detection terminals 240 and 210 of each cartridge are sequentially connected series in sequence so that whether one or more cartridges are unmounted or not is determined at once according to the detection of the voltage of the wiring 651 of connection end.

Furthermore, the first overvoltage detection terminals 210 of four cartridges IC1 to IC4 are connected to anode terminals of the diodes 641 to 644 through corresponding device side terminal 510. Also, the second overvoltage detection terminals 240 of four cartridges IC1 to IC4 are connected to anode terminals of the diodes 642 to 645 through corresponding device side terminal 540. The anode terminal of the second diode 642 is commonly connected to the second overvoltage detection terminal 240 of the first cartridges IC1 and the first overvoltage detection terminal 210 of the second cartridges IC2. Similarly, the diodes 643 and 644 are commonly connected to the second overvoltage detection terminal 240 of one cartridge and the first overvoltage detection terminal 210 of the adjacent cartridge. Cathode terminals of the diodes 641 to 645 are connected in parallel to the overvoltage detection section 620. The diodes 641 to 645 are used to monitor whether an abnormal high voltage (specifically, a voltage that exceeds the voltage value of the low voltage power supply VDD) is applied or not to the overvoltage detection terminals 210 and 240. Such an abnormal voltage value (referred to as "overvoltage") is generated when unintentional short-circuiting is generated between any one of the overvoltage detection terminals 210 and 240 of each cartridge, and any one of the mounting detection terminals 250 to 290 of each cartridge. For example, when ink droplets or dust become attached to the surface of the substrate 200 (FIG. 3A), unintentional short-circuiting may occur between the first overvoltage detection terminal 210 and the first mounting detection terminal 250, or between the second overvoltage detection terminal 240 and the second mounting detection terminal 290. When the unintentional short-circuiting occurs, the current flows to the overvoltage detection section 620 through any one of the diodes 641 and 645 so that the overvoltage detection section 620 may determine the presence or absence of the occurance of the overvoltage and the presence or absence of the occurance of unintentional short-circuiting, wherein the current may detect that a voltage having predetermined value or more is applied to the second overvoltage detection terminal 240. In addition, when the overvoltage is detected, a signal is supplied, which shows the occurrence of overvoltage to the detection voltage control section 610 from the overvoltage detection section 620. Accordingly, the detection voltage control section 610 turns off the transistor 612. This prevents a damage of the printing apparatus or cartridge, which may occur due to the overvoltage. In addition, the overvoltage detection section 620 is also referred to as the short circuit detection section.

As described above, in the second embodiment, the overvoltage detection terminals 210 and 240 are used in two processes, wherein two processes are that the detection process whether all cartridges are mounted in the holder 4 or not (the mounting detection of all cartridges) and the detection process that the unintentional short-circuiting is present or not between the overvoltage detection terminals 210 and 240, and the mounting detection terminals 250 and 290. However, one or both of two detection processes may be omitted. If two detection processes that use the overvoltage detection terminals 210 and 240 are not performed at both, circuit elements such as the overvoltage detection terminals 210, 240, 510 and 540, the diodes 641 to 645, and the overvoltage detection section 620 may be omitted.

Figure 8:
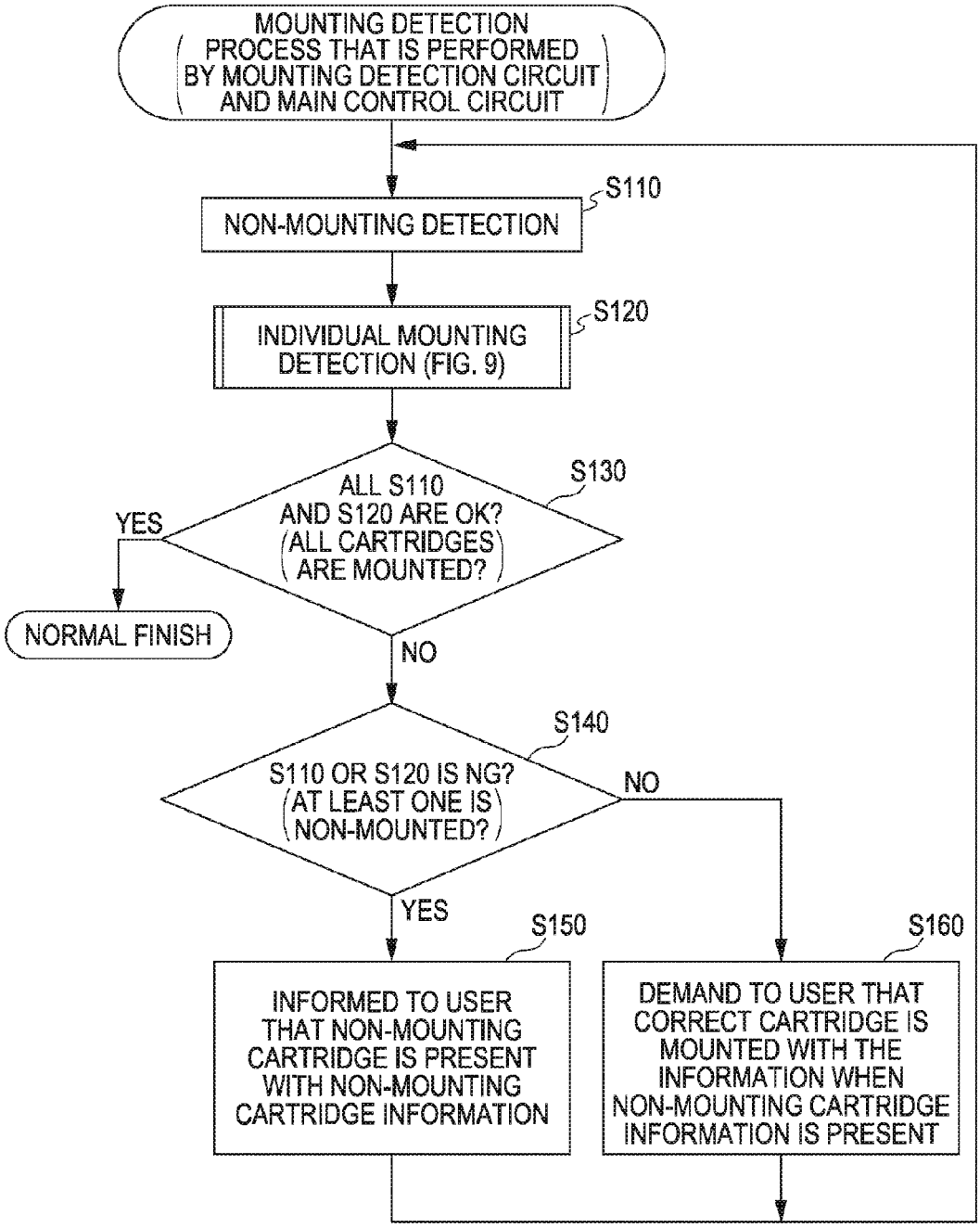
FIG. 8 is a flow chart illustrating an overall sequence of a mounting detection process.

FIG. 8 is a flow chart illustrating an overall sequence of mounting detection process that is performed by the main control circuit 40 and the cartridge detection circuit 502. The mounting detection process starts when the carriage 3 stops at a position for cartridge exchange (referred to as "the cartridge exchange position") and the cover 11 (FIG. 1) of the holder 4 opens. The cartridge exchange position is set beforehand near one end of the carriage 3 (for example, near the right end in FIG. 1) in the main scanning direction. The storage device 203 of the cartridge is in non-conductive state (a state that the power supply voltage VDD is not supplied) at the cartridge exchange position. In addition, the mounting detection process in FIG. 8 may be a process that is usually performed repeatedly when in a state where the power supply of the printing apparatus turns on.

When the carriage 3 stops at the cartridge exchange position, the non-mounting state detection section 430 (FIG. 6) detects whether all cartridges are mounted on the holder 4 or not in step S110 (the process is also referred to as simply "non-mounting detection process). Next, the circuit that includes the individual mounting current value detection section 630 (FIG. 7) performs the individual mounting detection process of the cartridge in step S120.

Figure 9:
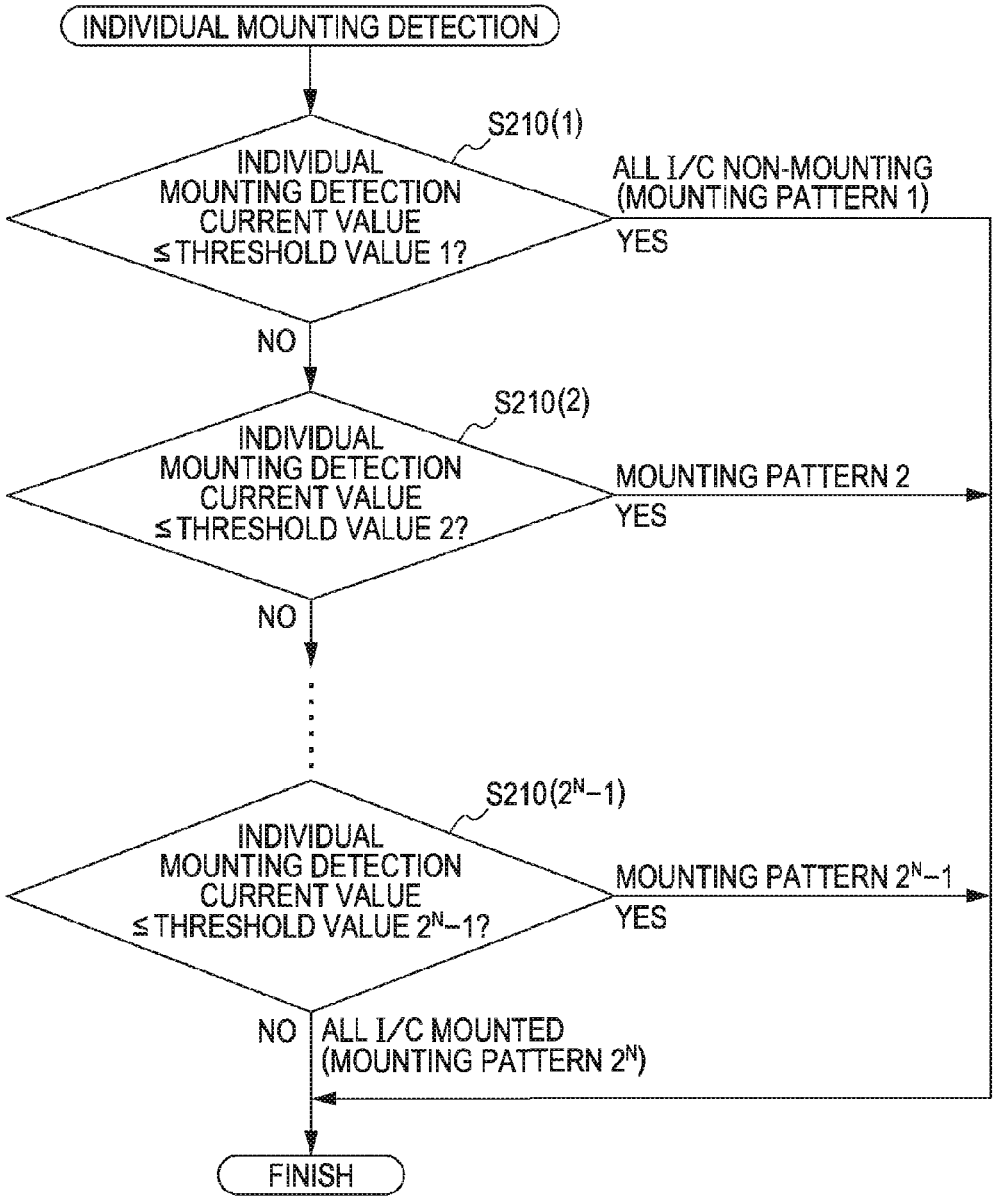
FIG. 9 is a flow chart illustrating a detailed sequence of an individual mounting detection process.

FIG. 9 is a flow chart illustrating a detailed sequence of the individual mounting detection process. The CPU 410 (FIG. 6) compares the value of the digital detection signal $S_{IDET}$ that is supplied from the individual mounting current detection section 630 (FIG. 7) and the first threshold value in step S210(1). The first threshold value is a value that is set beforehand that corresponds to the current value between the detection current value $I_{DET}$ in a case where all cartridges are non-mounted and the detection current value $I_{DET}$ in a case where the cartridge IC4 that corresponds to the resistance 704 having the maximum resistance value is mounted. If the detection current value $I_{DET}$ is the first threshold value or less, all cartridges are non-mounted and then the process in FIG. 9 finishes. Similarly to above, the threshold values that are set beforehand respectively and the detection current value $I_{DET}$ are compared so that any one of $2^N$ mounting states (mounting patterns) illustrated at the lower portion in FIG. 5B is determined until step S210($2^N$−1). Fifteen threshold values are used since N=4 in the embodiment. However, N may employ 2 or more of arbitrary integer and traditionally N employs 3, 4 or 6.

When the individual mounting detection process finishes, it returns to step S130 in FIG. 8 and determines whether both the non-mounting detection process in step S110 and the individual mounting detection process in step S120 are OK (passed) or not (whether all non-mounting states is not present and the individual non-mounting state is not present or not). If both are OK, the routine finishes normally. Meanwhile, if steps S110 and S120 are all NG (non-mounting state is present and individual unmounting state is present), it arrives step S150 from step S140 and informed to user that the non-mounting cartridge is present as well as the non-mounting cartridge information. Here, "non-mounting cartridge information" means the information (at least one of information such as cartridge color, the position of the cartridge inside holder or the like) of the non-mounting cartridge. Meanwhile, if only one of the steps S110 and S120 is NG (one of the non-mounting state and individual non-mounting state is present), it arrives step S160 from step S140 and the correct cartridge is mounted correctly inside holder, and the user is informed instantly. At this time, if non-mounting cartridge information is present (if non-mounting cartridge is specified by the individual mounting detection process), it is desirable that the non-mounting cartridge information also informs to the user.

As described above, in the second embodiment, the non-mounting state of each cartridge can inform to the user during the exchange of cartridges so that the user sees the display while performs the exchange of the cartridges. Especially, when cartridge is exchanged and new cartridge is mounted on the holder 4, the intent that the cartridge is mounted is displayed on the display panel 30 so that even though a user is inexperienced with the cartridge exchange operation, the user is capable of processing next operation with an easy mind. In addition, in the second embodiment, mounting and removing, and mounting detection of the cartridge is capable of being performed in a state where the storage device 203 of the cartridge is in a non-conductive state. Accordingly, bit error that is generated by so-called hot-plugging of the storage device is preventable.

Also, in the second embodiment, if overvoltage is generated at the overvoltage detection terminals 210 and 240, applying of the high voltage VHV for mounting detection is canceled instantly so that damage in the electric circuit of the printing apparatus or cartridge due to the overvoltage is preventable.

D. Modified Example of Mounting Detection Circuit

Figure 10:
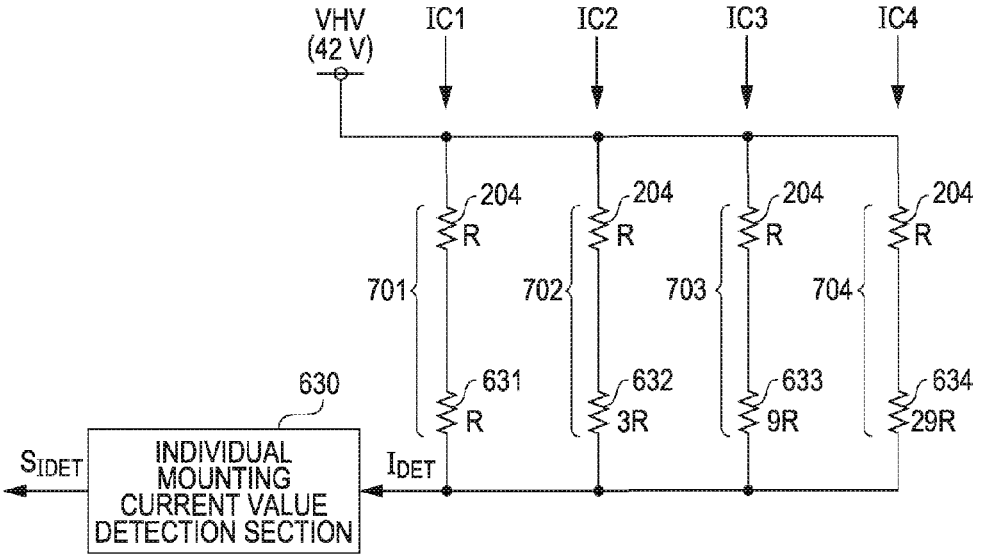
FIG. 10 is a circuit drawing illustrating another configuration example of a mounting detection circuit.

FIG. 10 is a circuit drawing illustrating another configuration example of the mounting detection circuit. The circuit is different from the circuit shown in FIG. 5A in the resistance value of the resistance elements 633 and 634. In the circuit shown in FIG. 10, the resistance values of the resistance elements 631 to 634 that are provided inside the cartridge detection circuit 502 corresponding to four cartridges IC1 to IC4 are R, 3R, 9R and 29R. As a result, the resistance values of four resistances 701 to 704 are 2R, 4R, 10 R and 30R. Here, the values of ratio of the resistance values of the resistances corresponding to two cartridges are 2 (ratio of IC1 and IC2) and 2.5 (ratio of IC2 and IC3) and 3 (ratio of IC3 and IC4), and are different values respectively. Generally, if two or more values as the ratio of the resistance values of the resistance corresponding to two cartridges are employed, the circuit configuration where the composition resistance value Rc is determined at once according to the mounting states of $2^N$ types of N cartridges is obtainable. As understandable from the example, the resistance values of the resistances 701 to 704 corresponding to each of cartridges is not required to be 2″R and various resistance values where the composition resistance value Rc is determined at once according to $2^N$ types of mounting states of N cartridges may be employed.

Figure 11:
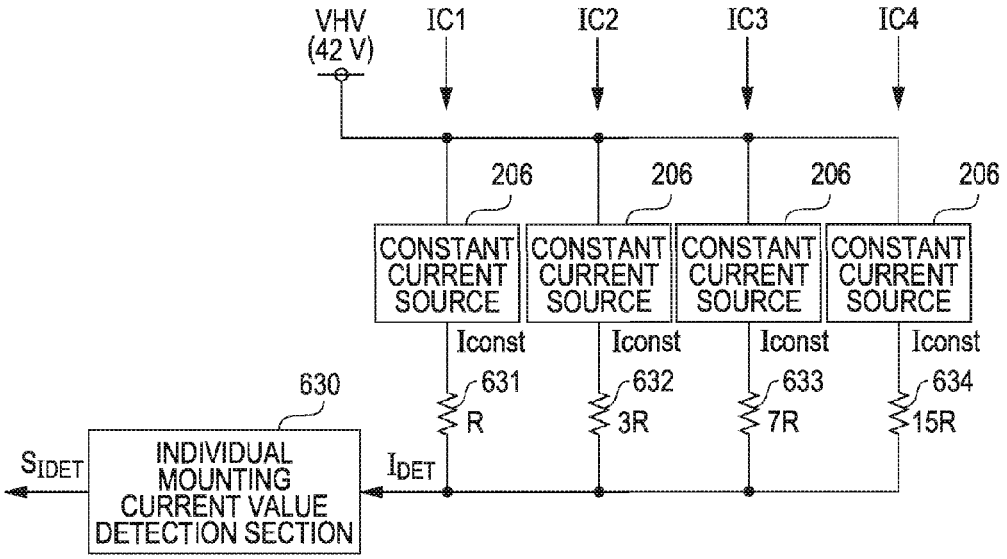
FIG. 11 is a circuit drawing illustrating another configuration example of a mounting detection circuit.

FIG. 11 is a circuit drawing illustrating another configuration example of the mounting detection circuit. The circuit substitutes a constant current source 206 for the resistance element 204 of the cartridge in FIG. 5A. These constant current sources 206 receive the high voltage VHV and output a constant current Iconst. The constant current Iconst sets a value such that the total value 4×Iconst is larger than the threshold value current Ithmax shown in FIG. 5B. Even in the configuration, the determination may be performed that cartridge is mounted at the determination section 660 (FIG. 5A) or the CPU 410 (FIG. 6). Also, in the configuration in FIG. 11, individual mounting detection cannot be performed, however may be used in specific usage (with a mounting state of one cartridge, when testing or cleaning is performed or when individual mounting detection is not performed).

In addition, in an electric device that is connected to the mounting detection terminals 250 and 290 (FIG. 3A) of the cartridge, arbitrary types of electric device other than the resistance element 204 or the constant current source 206 may be employed. However, it is desirable that these electric devices be configured such that the detection current $I_{DET}$ for individual mounting detection is a predetermined threshold value current Ithmax or more when N cartridges are all mounted inside the holder 4.

Various modified examples or modified examples regarding the first and the second embodiments may be applied to other embodiments described below.

E. Third Embodiment

Entire configuration of the circuit of the third embodiment is the same as the configuration of the second embodiment shown in FIG. 7 and the internal configuration of the cartridge detection circuit is different from that of the second embodiment.

Figure 12:
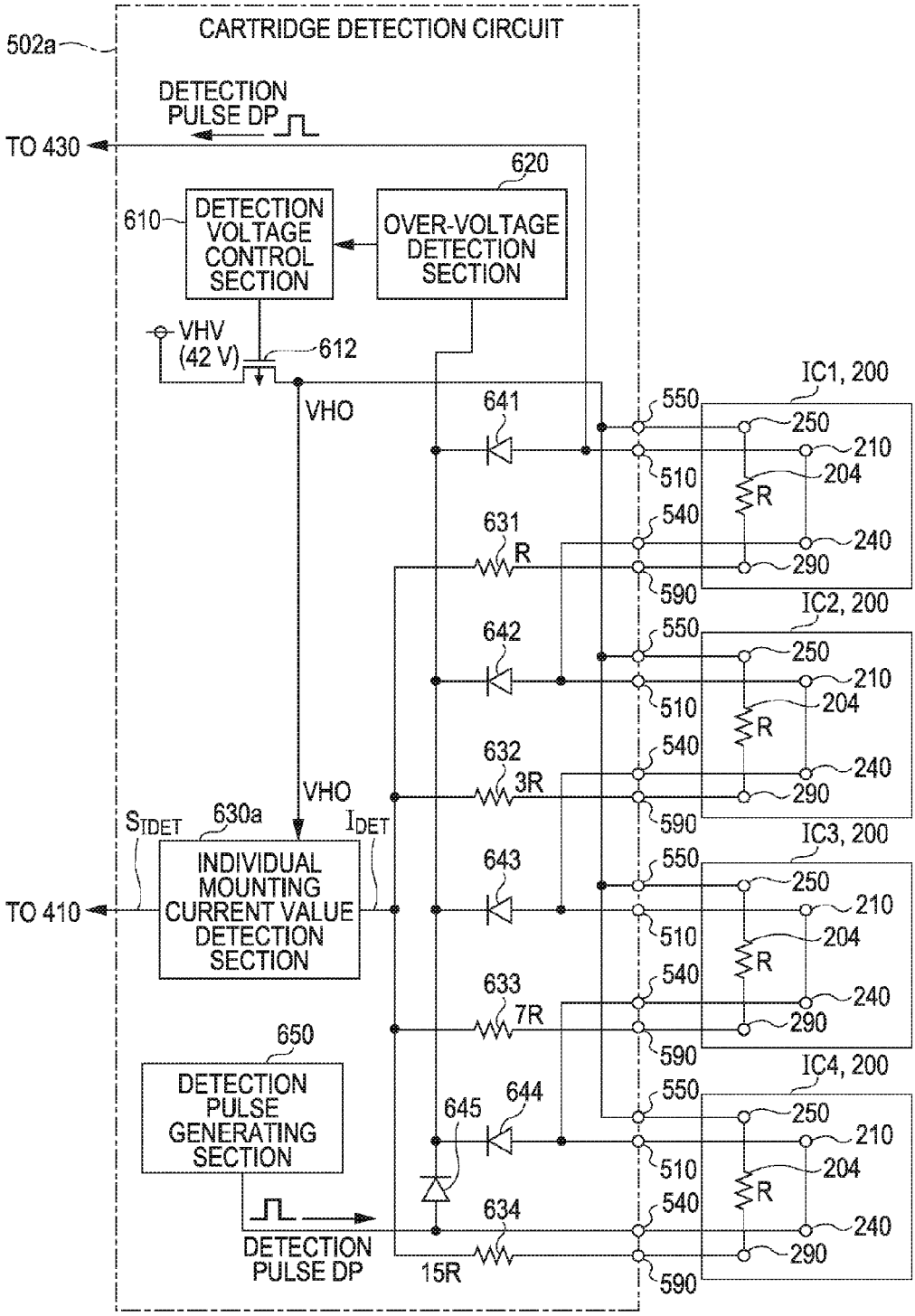
FIG. 12 is a drawing illustrating a configuration inside a cartridge detection circuit of a third embodiment.

FIG. 12 is a circuit drawing illustrating a configuration of a cartridge detection circuit of the third embodiment. There is difference between the circuit shown in FIG. 12 and the circuit shown in FIG. 7 in that the resistances 652 and 654 that are described in the cartridge detection circuit illustrated in FIG. 7 are omitted, a detection pulse generating section 650 is provided, and a voltage value VHO of output terminal of the transistor 612 is supplied to a individual mounting current value detection section 630*a*. Other configurations are the same as that of FIG. 7. The detection pulse generating section 650 generates a detection pulse DP having a rectangular shape in step S110 in FIG. 8. The detection pulse DP is received at the non-mounting state detection section 430 (FIG. 7), after sequentially via the overvoltage detection terminals 240 and 210 of all cartridges. The non-mounting state detection section 430 interprets a waveform of the detection pulse DP and then may determine whether the contacting state of the terminal of the ink cartridge is insufficient contacting state that is high resistance (contact error) or not. In other words, the non-mounting state detection section 430 may detect not only whether all cartridges are mounted or not simply but also whether there is in insufficient contacting state or not. If the contacting state is insufficient, for example, a prompt to remount of the cartridge may be displayed on the display panel 30.

Figure 13:
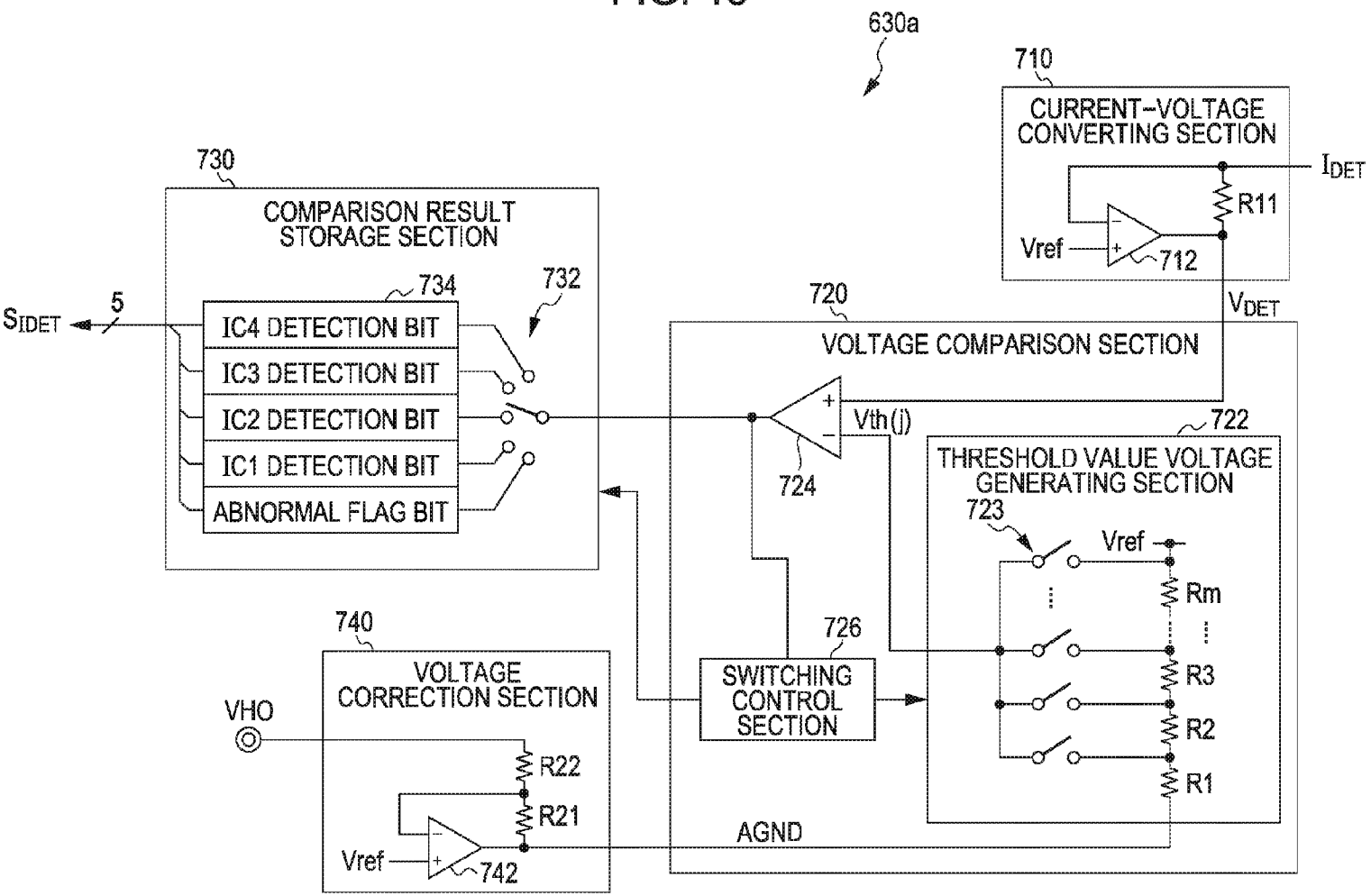
FIG. 13 is a drawing illustrating a configuration inside an individual mounting current value detection section of the third embodiment.

FIG. 13 is a drawing illustrating a configuration inside of the individual mounting current value detection section 630*a* of the third embodiment. The individual mounting current value detection section 630*a* has a current-voltage converting section 710, a voltage comparison section 720, a comparison result storage section 730 and a voltage correcting section 740.

The current-voltage converting section 710 is an inverting amplifier circuit that is configured of an operational amplifier 712 and a return resistance R11. The output voltage $V_{DET}$ of the operational amplifier 712 is given in below formula.

$$V_{DET} = Vref - I_{DET} \cdot R11 \tag{10}$$

$$= Vref - (VHO - Vref)\frac{R11}{Rc}$$

Here VHO is an output voltage of the transistor 512 (FIG. 12) and Rc is the composition resistance of four resistances 701 to 704 (FIG. 5A). The output voltage $V_{DET}$ has a voltage value that represents the detection current $I_{DET}$.

In addition, the voltage $V_{DET}$ that is given in formula 10 illustrates a value that is inversed voltage $I_{DET}$·R11 by the detection current $I_{DET}$. Thus, the inverting amplifier is added to the current-voltage converting section 710 and the voltage that inverses the voltage $V_{DET}$ at the added inverting amplifier may be output as the output voltage of the current-voltage converting section 710. It is desirable that the absolute value of the amplifying rate of the added inverting amplifier be 1.

The voltage comparison section 720 has a threshold value voltage generating section 722, a comparator 724 (the operational amplifier) and a changeover control section 726. The threshold value voltage generating section 722 selects one of a plurality of threshold value voltages Vth(j) that is obtained by dividing a reference voltage Vref into a plurality of resistances R1 to Rm as a changeover switch 723 and outputs it. The plurality of threshold value voltages Vth(j) correspond to the threshold values that identify the values of the detection current $I_{DET}$ in sixteen types of the mounting states shown in FIG. 5B. The comparator 724 compares the output voltage $V_{DET}$ of the current-voltage converting section 710 and threshold value voltages Vth(j) that are output from the threshold value voltage generating section 722, and the result of the comparison of two values is output. The result of the comparison of two values illustrates whether each of the cartridges IC1 to IC4 is mounted or not. In other words, the voltage comparison section 720 investigates whether each of the cartridges IC1 to IC4 is mounted or not and the result of the comparison is sequentially output. In a traditional example, first of all, the voltage comparison section 720 investigates whether the first cartridges IC1 that corresponds to the largest resistance 701 (FIG. 5A) is mounted or not and outputs the bit value that illustrates the result of the comparison. After that, the voltage comparison section 720 sequentially investigates whether the second to fourth cartridges IC2 to IC4 are mounted or not and outputs the bit value that illustrates the result of the comparison. Based on the result of the comparison regarding each cartridge, the changeover control section 726 controls the changeover of voltage value Vth(j) that is output from the threshold value voltage generating section 722 so as to detect the mounting of the next cartridge.

The comparison result storage section 730 changes over the comparison result of two values that are output from the voltage comparison section 720 in the changeover switch 732 and accommodate it in an appropriate bit position inside the bit resistor 734. The changeover timing of the changeover switch 732 is designated from the changeover control section 726. The bit resister 734 has N (here, N=4) cartridge detection bits that shows the presence or absence of the mounting of an individual cartridge that can be mounted on the printing apparatus and an abnormal flag bit that shows an abnormal current value being detected (the current value is predetermined abnormal determination value or more). The abnormal flag bit becomes H level if a significantly large current flows compared to the current value Imax (FIG. 5B) in the state where all cartridges are mounted. However, the abnormal flag bit may be omitted. A plurality of bit values that is accommodated in the bit resistor 734 is transmitted to the CPU 410 (FIG. 7) of the main control circuit 40 as a digital detection signal $S_{IDET}$ (a detection current signal). The CPU 410 determines whether individual cartridge is mounted or not from the bit value of the digital detection signal $S_{IDET}$. As described above, in the third embodiment, four bit values of the digital detection signal $S_{IDET}$ show whether individual cartridge is mounted or not. Accordingly, the CPU 410 may determine instantly whether individual cartridge is mounted or not from individual bit value of the digital detection signal $S_{IDET}$ without need to perform the process of step S210 shown in FIG. 9.

Both the voltage comparison section 720 and the comparison result storage section 730 configures so-called an A-D converting section. As the A-D converting section, known various other configurations may be employed instead of the voltage comparison section 720 and the comparison result storage section 730 shown in FIG. 13.

A voltage correcting section 740 is a circuit to correct the plurality of the threshold value voltages Vth(j) that are generated in the threshold value voltage generating section 722 following the change of the high voltage VHV (FIG. 12) for mounting detection. The voltage correcting section 740 is configured of an inverting amplifier circuit that is consisted of the operational amplifier 742 and two resistances R21 and R22. The output terminal voltage VHO of the transistor 612 in FIG. 12 is input into the inversing input terminal of the operational amplifier 742 through the input resistance R22 and the reference voltage Vref is input in the non-inversing input terminal. At this time, an output voltage AGND of the operational amplifier 742 is given in below formula.

$$AGND = Vref - (VHO - Vref)\frac{R21}{R22} \tag{11}$$

The voltage AGND is used as the reference voltage AGND of the low voltage side of the threshold value voltage generating section 722. For example, if Vref=2.4V, VHO=42V, R21=20 kΩ and R22=400 kΩ, AGND=0.42V is established. It may be understandable when above-described formula 10 and formula 11 are compared, the reference voltage AGND of the low voltage side of the threshold value voltage generating section 722 changes according to the value of the output voltage VHO (in other words, the high voltage power supply VHV for mounting detection) of the transistor 612, similar to the detection voltage value $V_{DET}$. The difference between two voltages AGND and $V_{DET}$ is generated by the difference between resistance ratio between R21/R22 and R11/Rc. As described above, when the voltage correcting section 740 is used, the plurality of the threshold value voltages Vth(j) that are generated at the threshold value voltage generating section 722 changes following the change of the power supply voltage VHV even though the power supply voltage VHV for mounting detection is changed by any cause. As a result, both the detection voltage value $V_{DET}$ and the plurality of the threshold value voltages Vth(j) change following the change of the power supply voltage VHV so that the result of comparison that shows a precision mounting state is obtainable in the voltage comparison section 720. Specifically, when the values of the resistance ratio R21/R22 and the resistance ratio R11/$R_{c1}$ ($R_{c1}$ is the composition resistance value when all cartridges are mounted) are set in the same value, the detection voltage value $V_{DET}$ and the plurality of the threshold value voltages Vth(j) may precisely follow the change of the power supply voltage VHV so as to change with substantially the same change width. However, the voltage comparison section 720 may be omitted.

As described above, even in the third embodiment, advantages the same as the second embodiment may be present. In other words, the unmounting state of an individual cartridge is displayed on the display panel 30 during the exchange of cartridge so that the user performs the exchange of the cartridge while seeing the display. Also, mounting and removing, and the mounting detection of the cartridge are capable of being performed in a state where the storage device 203 of the cartridge is in a non-conductive state. Accordingly, bit error that is generated by so-called hot-plugging of the storage device is preventable. Furthermore, if overvoltage is generated at the overvoltage detection terminals 250 and 290, applying of the high voltage VHV for mounting detection is canceled instantly so that damage in the electric circuit of the printing apparatus or cartridge due to the overvoltage is preventable. Furthermore, in the third embodiment, the individual bit value of the digital detection signal $S_{IDET}$ that is generated at the individual mounting current value detection section 630*a* shows the presence or absence of the mounting of an individual cartridge so that the presence or absence of the mounting of an individual cartridge is determined at once by the bit value of the digital detection signal $S_{IDET}$.

F. Fourth Embodiment

Figure 14:
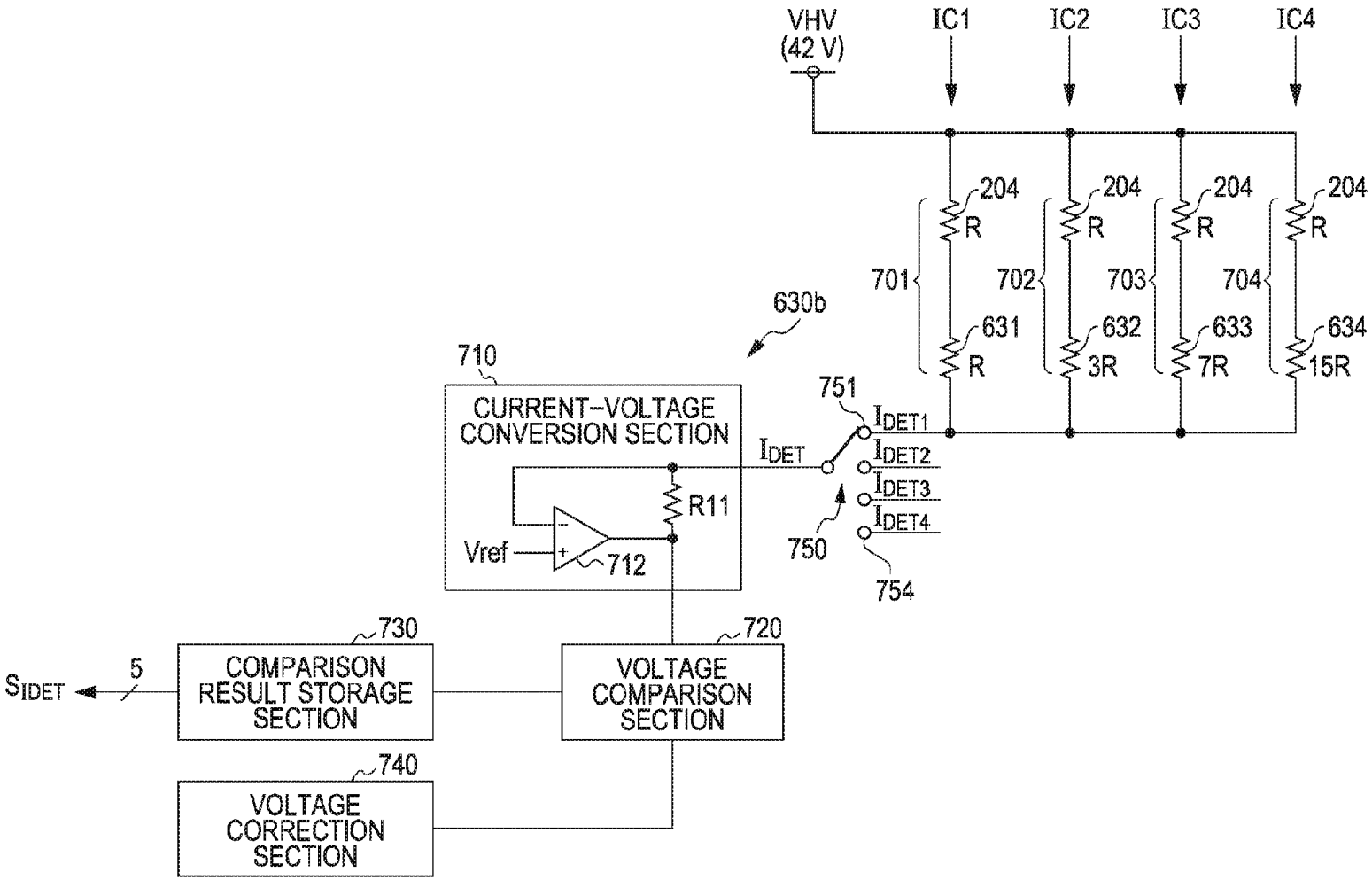
FIG. 14 is a drawing illustrating a configuration an individual mounting current value detection section of a fourth embodiment.

FIG. 14 is a drawing illustrating a configuration of an individual mounting detection section 630*b* of a fourth embodiment. The individual mounting detection section 630*b* is that an input changeover switch 750 is added to the individual mounting detection section 630*a* of the third embodiment shown in FIG. 13. The input changeover switch 750 selects any one of the detection currents $I_{DET1}$ to $I_{DET4}$ that are input from a plurality of the input terminals 751 to 754 and inputs it to a current-voltage converting section 710. The detection current $I_{DET1}$ that flows the parallel connection of the resistances 701 to 704 that are the same as that shown in FIG. 5A is input into the first input terminal 751. Even in other input terminals 752 to 754, similarly the detection currents $I_{DET2}$ to $I_{DET4}$ that flow in the parallel connection of the resistances that are corresponding four or less cartridges are input respectively. In addition, the configurations of inside of other circuit elements 710 to 740 are not shown in FIG. 14 since these are the same as that in FIG. 13.

If such input changeover switch 750 is provided, the mounting detection of each cartridge may be performed the same as above description even in a printing apparatus where the plurality of cartridges are mounted.

G. Fifth Embodiment

Figure 15:
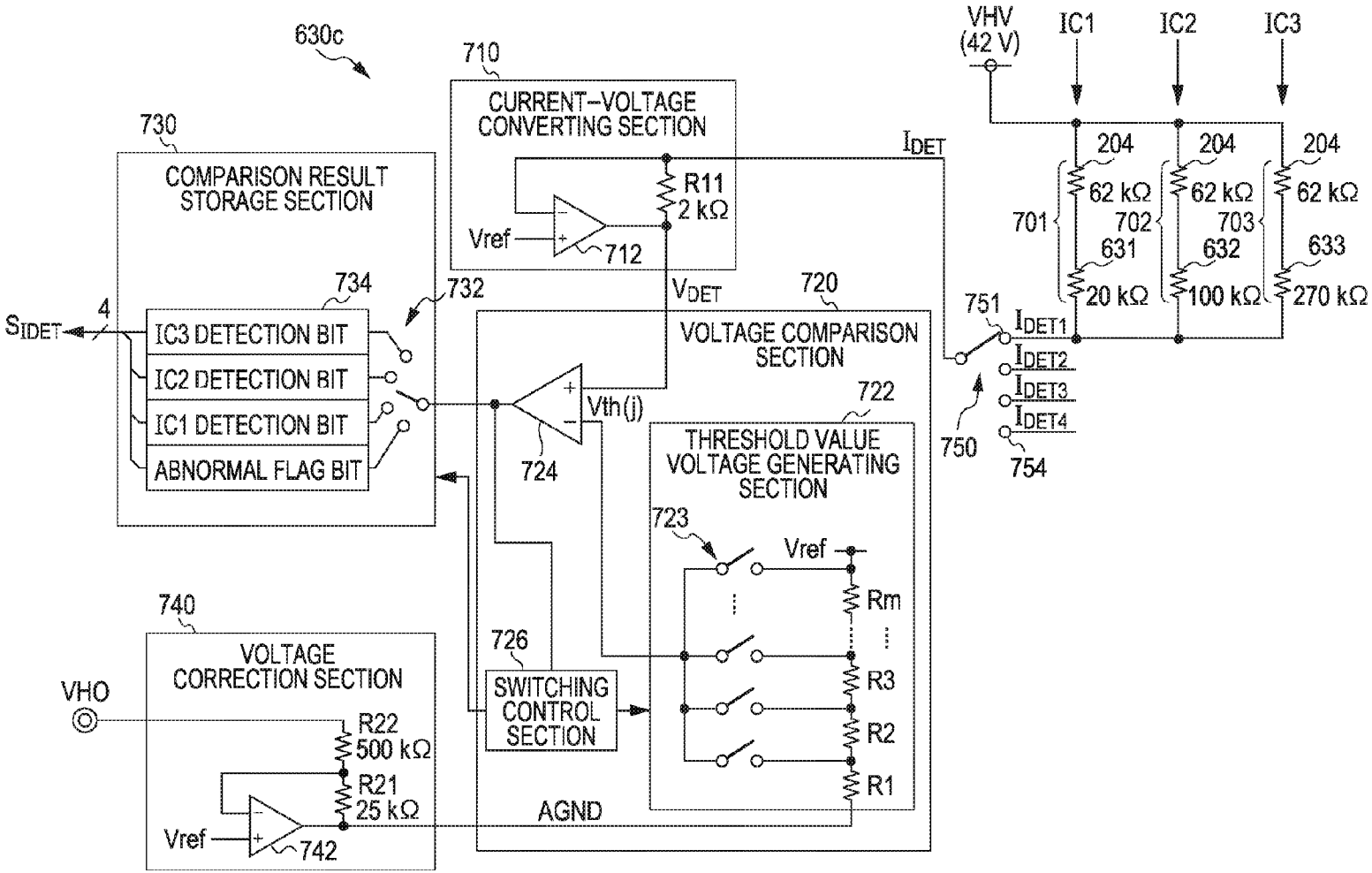
FIG. 15 is a drawing illustrating a configuration an individual mounting current value detection section of a fifth embodiment.

FIG. 15 is a drawing illustrating a configuration of an individual mounting detection section 630*c* of a fifth embodiment. The individual mounting detection section 630*c* has a configuration that is substantially the same as the individual mounting detection section 630*b* of the fourth embodiment shown in FIG. 14. However, the detection current $I_{DET1}$ that flows in the parallel connection of the resistances 701 to 703 for mounting detection for three cartridges IC1 to IC3 is input into the first input terminal 751 of the input changeover switch 750. Even in other input terminals 752 to 754, similarly the detection currents $I_{DET2}$ to $I_{DET4}$ that flow in the parallel connection of the resistances 701 to 703 for mounting detection that are corresponding three cartridges respectively are input respectively. In other words, in the circuit of the fifth embodiment, when the resistances 701 to 703 for mounting detection for maximum three ink cartridges of four input terminals 751 to 754 may be connected in parallel, the mounting states of a maximum of twelve ink cartridges can be determined individually.

In FIG. 15, the resistance value of the resistance element 204 inside each cartridge is set to 62 kΩ. In addition, the resistance values of the resistance elements 631 to 633 of the printing apparatus side are set to 20 kΩ, 100 kΩ and 270 kΩ. Accordingly, the resistance values of the resistances 701 to 703 for mounting detection for three cartridges IC1 to IC3 are 82 kΩ, 162 kΩ and 332 kΩ. The resistance values (82 kΩ, 162 kΩ and 332 kΩ) of resistances 701 to 703 for mounting detection are values that substantially close to 2R, 4R and 8R which are values when R=41 kΩ. In other words, the resistance values of the resistances 701 to 703 for mounting detection are substantially the same as the resistance values 2R, 4R and 8R of the resistances 701 to 703 for mounting detection shown in FIGS. 5A, 10 and 14. Strictly speaking, when R=41 kΩ, 82 kΩ=2R, 162 kΩ=4R×(1−0.012) and 332 kΩ=8R×(1+0.012). However, this degree of difference (±1.2%) of the design value may be sufficiently permitted when performing the individual detection of the cartridge even though considering the manufacturing error or temperature dependence of the resistance value.

In FIG. 15, the resistance values of the resistance elements 204, 631 to 633 that constitute the resistances 701 to 703 for mounting detection are set considering conditions described below.

(1) The resistance value of each resistance element is 20 kΩ or more.

Then, the current that flows to the resistance element is capable of being limited to 2.1 mA or less as the calculation described below even though it is supposed that the highest voltage VHV that is used at the mounting detection circuit is applied to 20 kΩ of resistance element.

$$(44.1V-2.4V)/20\ k\Omega=2.085\ mA<2.1\ mA$$

Here, 44.1V is maximum value (absolute maximum voltage=42V+5%) of the voltage VHV when the regular value of the voltage VHV is 42V and allowable range is ±5%. Also, 2.4V is a value of the reference voltage Vref that is used at the current-voltage converting section 710. (44.1V−2.4V)=41.7V corresponds to the maximum value of the voltage that is applied to both end of the resistance element. As described above, when the resistance value of each resistance element is 20 kΩ or more, the current is capable of being limited to 2.1 mA or less so that the ASIC that realizes the mounting detection circuit is capable of being protected.

(2) The resistance value of the resistance element 204 that is loaded on the ink cartridge is larger than the minimum resistance value of the resistance elements 631 to 633 inside the mounting detection circuit.

Then, by any possibility, even though the resistance element 204 that is loaded on the ink cartridge is short-circuited for any reason, the abnormal state is easily detected. In addition, the resistance element 204 is traditionally attached at rear surface side of the substrate 200 (FIG. 3A). The distance between terminals of the resistance element 204 that is attached is small about 1 mm so that there is a possibility that the short circuit may occur between terminals of the resistance element 204 by any cause when the substrate 200 is manufactured or the like, but even in this case, the abnormal state is easily and correctly detected.

(3) The minimum value of the detection current $I_{DET}$ is 100 μA or more.

Then, even though if influence of disturbance (noise) is present, the detection current $I_{DET}$ easily and correctly determines the mounting state of the cartridge. In addition, in the circuit configuration shown in FIG. 15, even though it is supposed that three cartridges IC1 to IC3 are all mounted, the manufacturing error of the resistance value is ±1% and error is 0.7% by temperature dependence of the resistance value, the minimum value of the detection current $I_{DET}$ is about 117 μA so that the condition can be sufficiently satisfied.

Also, these conditions (1) to (3) are desirable conditions, however these conditions are not essentially satisfied and other conditions may be set.

In addition, in FIG. 15, the resistance values of resistances R11, R21 and R22 of the individual mounting detection section 630*c* are set to 2 kΩ, 25 kΩ and 500 kΩ. As described in FIG. 13, these resistance values are set so as to be substantially the same values of the resistance ratio R21/R22 and the resistance ratio R11/$R_{c1}$ ($R_{c1}$ is the composition resistance value when all cartridges are mounted). Accordingly, even in the circuit shown in FIG. 15, the detection voltage value $V_{DET}$ and the plurality of the threshold value voltages Vth(j) may precisely follow the change of the power supply voltage VHV so as to change with substantially the same change width.

In the fourth embodiment shown in FIG. 14 and the fifth embodiment shown FIG. 15, one set of cartridges is configured by a portion of the plurality of cartridges that are mounted inside the holder 4 of the printing apparatus and the mounting state of the cartridges is detected by the mounting detection circuit. For example, in the circuit drawing shown FIG. 14, one set of cartridges is configured of four cartridges IC1 to IC4. In addition, the holder 4 may be used in which the maximum sixteen cartridges are mountable. Also, in the circuit drawing shown FIG. 15, one set of cartridges is configured of three cartridges IC1 to IC3. In addition, the holder 4 may be used in which the maximum twelve cartridges are mountable. As understandable from these description, as the mounting detection circuit, it is desirable that the mounting detection circuits have the circuit configuration that can detect $2^N$ different mounting states with respect to each of the cartridge sets that is configured of N (N is integer of 2 or more) cartridges. In addition, term "cartridge set" is term including not only a set that is configured of all cartridges that are mounted in the holder of the printing apparatus but also a set that is configured of only a portion of the plurality of cartridges.

H. Other Embodiments

Figure 16A:
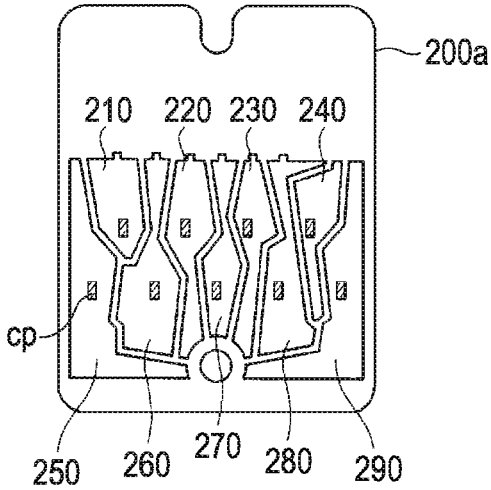
FIGS. 16A to 16C are drawings illustrating a configuration of a substrate of another embodiment.
Figure 16B:
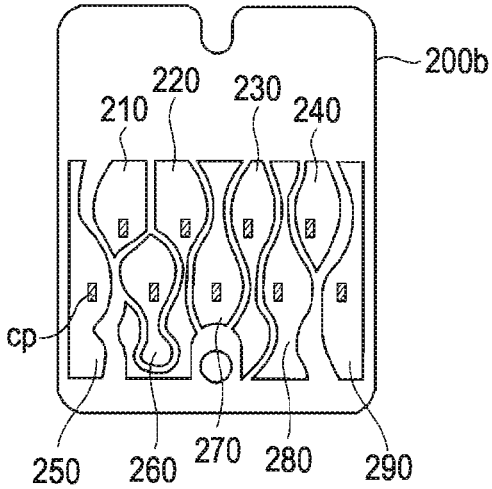
Figure 16C:
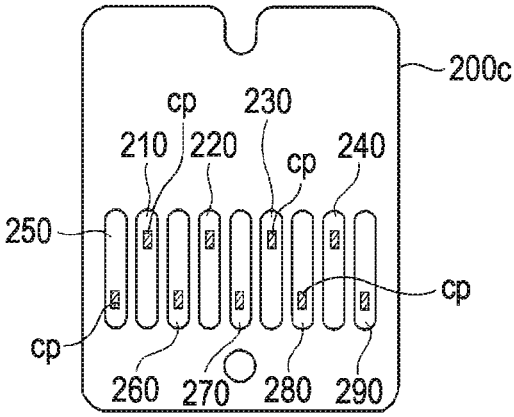

FIGS. 16A to 16C are drawings illustrating a configuration of a substrate of another embodiment. Substrates 200*a* to 200*c* are only different from surface shape of the substrate 200 and the terminals 210 to 290 shown FIG. 3A. However, even in the substrates 200*a* to 200*c*, the positions of the contacting section cp and device side terminal corresponding to each of the terminals 210 to 290 are the same as the substrate 200 shown FIG. 3A. As described above, as the surface shape of an individual terminal, t surface shape of each terminal may be deformed in variety as far as the contacting sections cp have the same arrangement.

Figure 17:
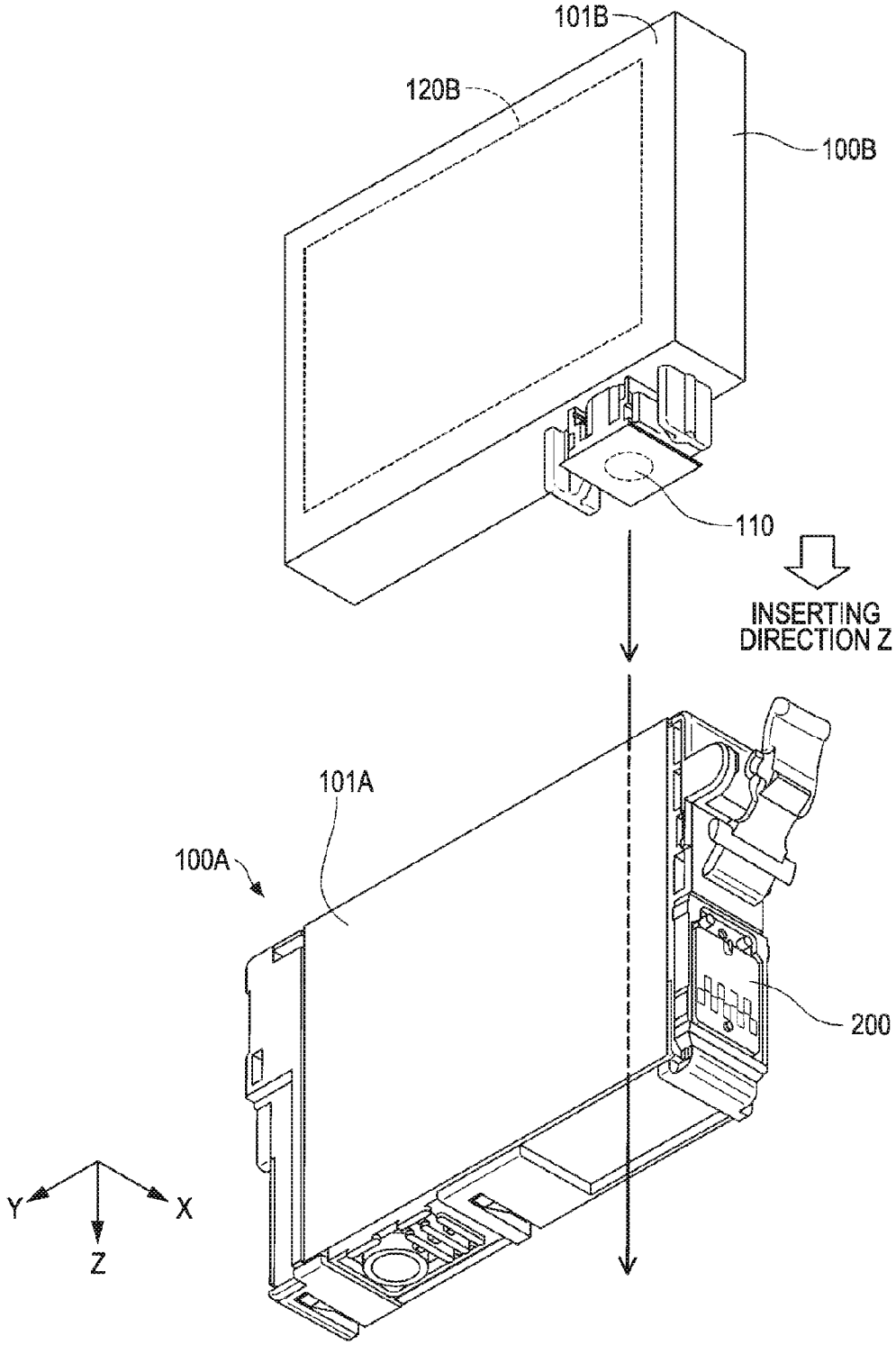
FIG. 17 is a perspective view illustrating a configuration of an ink cartridge of another embodiment.
Figure 18:
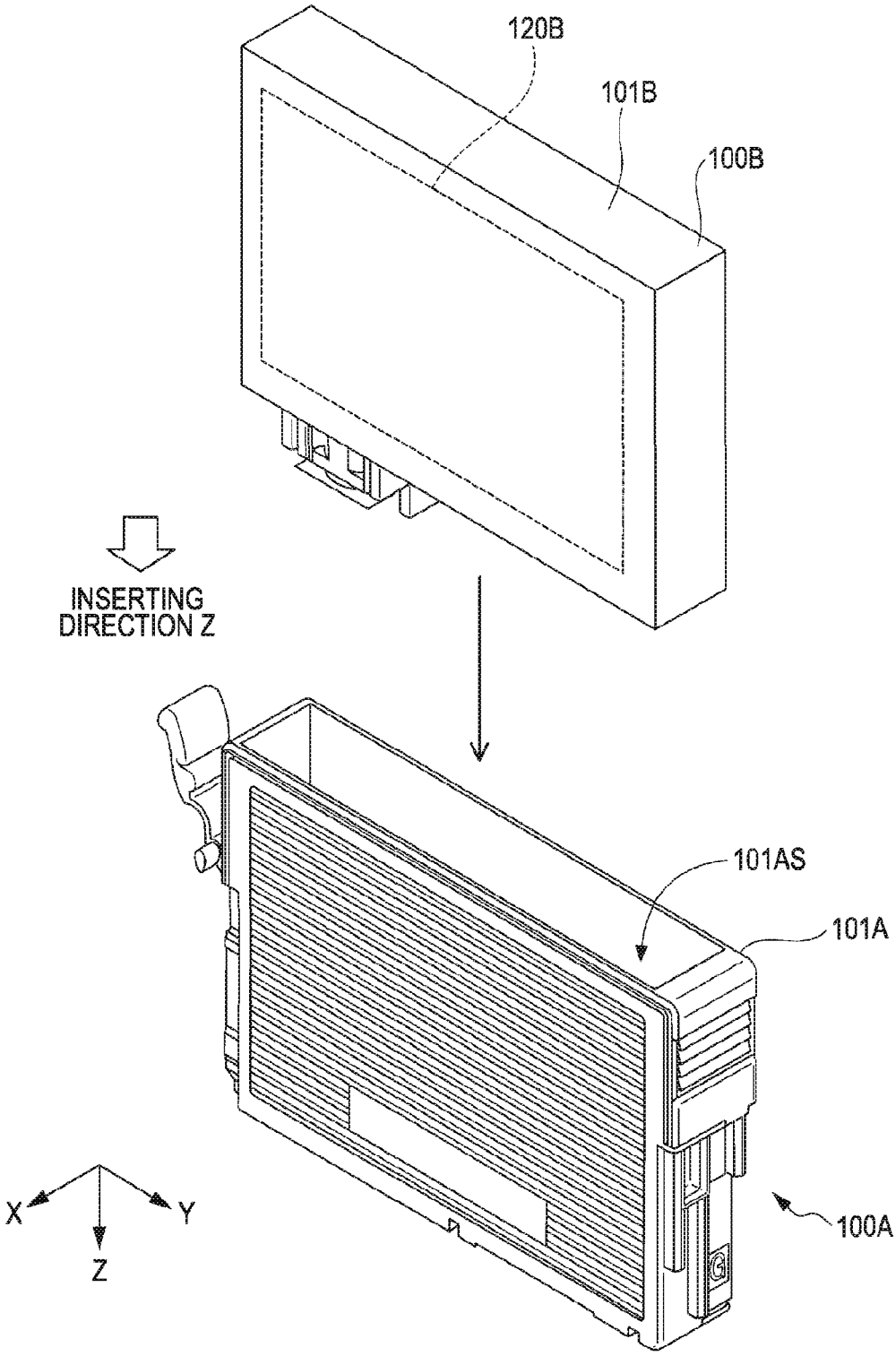
FIG. 18 is a perspective view illustrating a configuration of an ink cartridge of another embodiment.

FIGS. 17 and 18 are perspective views illustrating configuration of the ink cartridges of other embodiments. The ink cartridge is separated into an ink container 100B and an adapter 100A.

The ink container 100B includes a case 101B that contains ink and the ink supply opening 110. An ink chamber 120B that contains ink is formed inside the case 101B. The ink supply opening 110 is formed at the bottom wall of the case 101B. The ink supply opening 110 communicates with the ink chamber 120B.

The adapter 100A includes a main body 101A and the substrate 200. A space 101AS that receives the ink container 100B is formed inside the main body 101A. An opening that communicates with the space 101AS is provided on the upper portion of the main body 101A. In a state where the ink container 100B is received within the space 101AS, the ink supply opening 110 is projected to outside of the adapter 100A through an opening 101AH. In addition, a portion of sidewall of the adapter 100A may be omitted.

As described above, the ink cartridge is capable of being separated into the ink container 100B (also referred to as "printing material containing body") and the adapter 100A. In this case, it is desirable that the circuit substrate 200 be provided at the adapter 100A side.

I. MODIFIED EXAMPLE

Also, the invention is not limited to the above-described embodiments or examples, various forms may be performed without departing from the gist thereof and for example, and modifications may be performed as below.

Modified Example 1

In above-described each of the embodiments, the storage device 203 and the resistance element 204 are loaded on the ink cartridge, however a plurality of electrical devices that are loaded on the ink cartridge are not limited to them and one or more arbitrary types of electrical devices may be loaded on the ink cartridge. For example, as a sensor for the ink amount detection, an electrical device (for example, a piezoelectric element or a resistance element) may be provided in the ink cartridge instead of the optical sensor. In addition, in the above-described embodiments, both the storage device 203 and the resistance element 204 are provided at the substrate 200, however the electrical device of the cartridge may be arranged on any arbitrary member. For example, the storage device 203 may be arranged on a structure body other than the casing of the cartridge, the adapter or cartridge.

Modified Example 2

In above-described each of the embodiments, four resistances for mounting detection 701 to 704 are formed with the resistance element 204 inside $n^{th}$ cartridge and corresponding resistance element 63*n* (n=1 to 4) inside the cartridge detection circuit 502, however the resistance value of the resistance for mounting detection may be realized by only one resistance element. Also, it may be realized by three or more resistance elements. For example, the resistance 701 for mounting detection that is configured of two resistance elements 204 and 631 may be substituted with single resistance element. Other resistances for mounting detection are also the same as the above description. In a case where one resistance for mounting detection is configured of a plurality of resistance elements, the resistance values of the resistance elements may be distributed arbitrarily. Also, a single resistance element or the plurality of resistance elements may be provided on only one side of the cartridge and the main body of the printing apparatus. For example, if all the resistances for mounting detection are mounted on the cartridge, the resistance elements that configure resistances for mounting detection are not required at the main body of the printing apparatus.

Modified Example 3

Constitutional elements in the various constitutions that are described in the above-described embodiments, which do not relate to a specific object•effect•advantage may be omitted. For example, the storage device 203 inside the cartridge may be omitted in a case where the individual mounting detection of the cartridge is a main object since it is not used in the individual mounting detection of the cartridge.

Modified Example 4

In above-described each of the embodiments, the invention is applied to an ink cartridge, however the invention is not limited to the ink cartridge and may be applied similarly to even other printing materials for example, a printing material containing body that contains toner.

The entire disclosure of Japanese Patent Applications Nos. 2010-197314, filed Sep. 3, 2010 and 2011-151692, filed Jul. 8, 2011 are expressly incorporated by reference herein.

What is claimed is:

1. A printing material cartridge detachably mountable in a holder of a printing apparatus, the printing apparatus including a power supply and a mounting detection circuit having a mounting current value detection section that detects a detection current that flows when at least one printing material cartridge among a cartridge set configured of N (N is integer of 2 or more) printing material cartridges is mounted in the holder of a printing apparatus, the mounting detection circuit detecting a mounting state of the cartridge set in the holder according to the detection current, the printing material cartridge comprising:

a storage device storing information regarding the printing material cartridge;

an electric device for the mounting detection;

a plurality of storage device terminals and a plurality of electric device terminals;

wherein, the electric device is, (i) arranged to be connected in parallel to which the electric device of another printing material cartridge of the cartridge set between the power supply and the mounting current value detection section when the cartridge set is mounted in the printing apparatus, and (ii) configured such that the detection current is a predetermined threshold value current or more when N printing material cartridges are mounted inside the holder, and wherein the plurality of storage device terminals include a ground terminal and wherein the plurality of electrical device terminals lack a ground terminal connection within the printing material cartridge;

wherein the electric device of N printing material cartridges is configured such that the detection current is a different current values depending on which of the printing material cartridges in the cartridge set are mounted in the holder;

the printing apparatus further comprising a resistance element of apparatus side;

wherein the electric device of $n^{th}$ (n=1 to N) printing material cartridge in N printing material cartridges is a resistance element, wherein the resistance element of $n^{th}$ printing material cartridge is connected the mounting detection resistances in series between the power supply for the mounting detection and the mounting current value detection section;

the mounting current value detection section further comprising:

a current-voltage converting section that generates the detection voltage by converting the detection current into the voltage;

an A-D converting section that compares the mounting detection voltage with a plurality of threshold value voltages and converts it into a digital detection signal; and a voltage correction section that corrects the plurality of threshold value voltages according to variation of the voltage of the power source for the mounting detection, wherein the mounting detection circuit determines the mounting state of the printing material cartridge in the holder based on the digital detection signal.

2. The printing material cartridge according to claim 1, wherein the electric device is configured such that the detection current is a different current value depending on which of the printing material cartridge in the cartridge set are mounted in the holder.

3. The printing material cartridge according to claim 2, wherein the electric device is a resistance element.

4. A cartridge set configured of N (N is integer of 2 or more) printing material cartridges and mountable inside a holder of the same printing apparatus, wherein individual printing material cartridge configured of the cartridge set is the printing material cartridges according to claim 1 and arrangement of contacting sections of the printing apparatus side terminals and the plurality of terminals on each printing material cartridge is common in the N printing material cartridges.

5. The cartridge set according to claim 4, wherein the electric device is a resistance element, and wherein the resistance elements of an individual printing material cartridge has the same resistance value.

6. The cartridge set according to claim 5, wherein a voltage applied to both ends of the resistance element of an individual printing material cartridge is 42V or less and a resistance value of the resistance element of an individual printing material cartridge is 20 kΩ or more.

7. A printing apparatus comprising:

a holder in which a cartridge set configured of N (N is integer of 2 or more) printing material cartridges that are independently mountable and different from each other is mounted;

a power supply for mounting detection; and a mounting detection circuit including a mounting current value detection section that detects a detection current that flows when one or more printing material cartridges in the holder are mounted, the mounting detection circuit detecting a mounting state of N printing material cartridges according to the detection current, wherein each of N printing material cartridges has a storage device storing information regarding the printing material cartridge, an electric device for the mounting detection, a plurality of storage device terminals and a plurality of electric device terminals, the electric device of N printing material cartridges is, (i) connected in parallel between the power supply for mounting detection and the mounting current value detection section, and (ii) configured such that the detection current that is detected at the mounting current value detection section is a predetermined threshold value current or more when the N printing material cartridges are mounted inside the holder;

wherein the electric device of N printing material cartridges is configured such that the detection current is a different current values depending on which of the printing material cartridges in the cartridge set are mounted in the holder;

the printing apparatus further comprising a resistance element of apparatus side;

wherein the electric device of $n^{th}$ (n=1 to N) printing material cartridge in N printing material cartridges is a resistance element, wherein the resistance element of $n^{th}$ printing material cartridge is connected the mounting detection resistances in series between the power supply for the mounting detection and the mounting current value detection section;

the mounting current value detection section further comprising:

a current-voltage converting section that generates the detection voltage by converting the detection current into the voltage;

an A-D converting section that compares the mounting detection voltage with a plurality of threshold value voltages and converts it into a digital detection signal; and a voltage correction section that corrects the plurality of threshold value voltages according to variation of the voltage of the power source for the mounting detection, wherein the mounting detection circuit determines the mounting state of the printing material cartridge in the holder based on the digital detection signal.

8. The printing apparatus according to claim 7, wherein a voltage that is higher than the voltage that is applied to the storage device terminals is supplied from the power supply for the mounting detection to the electric device terminals, wherein N printing material cartridges further have overvoltage detection terminals respectively, which are provided near the electric device terminals, and wherein the supply of the voltage from the power supply for the mounting detection to the electric device is stopped when the overvoltage is detected through the overvoltage detection terminal.

9. The printing apparatus according to claim 7, further comprising the cartridge set.

* * * * *